US008344984B2

(12) United States Patent
Min et al.

(10) Patent No.: US 8,344,984 B2
(45) Date of Patent: Jan. 1, 2013

(54) LIQUID CRYSTAL DISPLAY AND METHOD OF DRIVING THE SAME

(75) Inventors: Woongki Min, Daegu (KR); Hongsung Song, Kyungbuk (KR); Donghak Lee, Kyungbuk (KR)

(73) Assignee: LG Display Co., Ltd., Seoul (KR)

( * ) Notice: Subject to any disclaimer, the term of this patent is extended or adjusted under 35 U.S.C. 154(b) by 410 days.

(21) Appl. No.: 12/647,914

(22) Filed: Dec. 28, 2009

(65) Prior Publication Data

US 2010/0231564 A1 Sep. 16, 2010

(30) Foreign Application Priority Data

Mar. 11, 2009 (KR) ..... 10-2009-0020658

(51) Int. Cl.
*G09G 3/36* (2006.01)

(52) U.S. Cl. ..... 345/96; 345/99; 345/209

(58) Field of Classification Search ..... 345/96, 345/99, 209
See application file for complete search history.

(56) References Cited

U.S. PATENT DOCUMENTS

| | | | | |
|---|---|---|---|---|
| 2005/0151752 | A1* | 7/2005 | Phan | 345/589 |
| 2005/0168425 | A1 | 8/2005 | Takada et al. | |
| 2006/0012593 | A1* | 1/2006 | Iriguchi et al. | 345/204 |
| 2006/0256054 | A1 | 11/2006 | Baek | |
| 2007/0030236 | A1* | 2/2007 | Kim et al. | 345/98 |
| 2007/0205972 | A1* | 9/2007 | Asao et al. | 345/88 |
| 2007/0262310 | A1* | 11/2007 | Park et al. | 257/59 |
| 2009/0115772 | A1* | 5/2009 | Shiomi et al. | 345/214 |

FOREIGN PATENT DOCUMENTS

| | | | |
|---|---|---|---|
| CN | 1648980 | A | 8/2005 |
| CN | 1862646 | A | 11/2006 |
| JP | 9015560 | A | 1/1997 |
| JP | 11282434 | A | 10/1999 |
| JP | 2002062855 | A | 2/2002 |
| JP | 2005189820 | A | 7/2005 |
| JP | 2005266803 | A | 9/2005 |
| JP | 2006072391 | A | 3/2006 |
| JP | 2006126475 | A | 5/2006 |
| JP | 2008076416 | A | 4/2008 |
| JP | 2008242144 | | 10/2008 |

OTHER PUBLICATIONS

Japanese Office Action (Patent Application No. 2009-290280) dated Mar. 5, 2012, with English translation.
Chinese Office Action dated Jan. 31, 2012, with English translation.

* cited by examiner

*Primary Examiner* — Amr Awad
*Assistant Examiner* — Jonathan Boyd
(74) *Attorney, Agent, or Firm* — Morgan, Lewis & Bockius LLP

(57) ABSTRACT

A liquid crystal display and a method of driving the same are provided. The liquid crystal display includes a liquid crystal display panel including data lines, gate lines crossing the data lines, and liquid crystal cells and having a quad type pixel structure in which red, green, blue, and white subpixels constitute one pixel, a logic circuit sequentially outputting polarity control signals, a data drive circuit that inverts a polarity of a data voltage in response to the polarity control signals to supply the data voltage with the inverted polarity to the data lines, and a gate drive circuit sequentially supplying gate pulses to the gate lines. A logic level of each of the polarity control signals is inverted every three horizontal periods, and phases of the polarity control signals are different from one another.

15 Claims, 20 Drawing Sheets

LIQUID CRYSTAL DISPLAY AND METHOD OF DRIVING THE SAME

This application claims the benefit of Korea Patent Application No. 10-2009-0020658 filed on Mar. 11, 2009, the entire contents of which is incorporated herein by reference for all purposes as if fully set forth herein.

BACKGROUND OF THE INVENTION

1. Field of the Invention

Embodiments of the invention relate to a liquid crystal display having a quad type pixel structure including red, green, blue, and white subpixels and a method of driving the same.

2. Discussion of the Related Art

Active matrix type liquid crystal displays display a moving picture using a thin film transistor (TFT) as a switching element. The active matrix type liquid crystal displays have been implemented in televisions as well as display devices in portable devices, such as office equipment and computers, because of the thin profile of an active matrix type liquid crystal displays. Accordingly, cathode ray tubes (CRT) are being rapidly replaced by active matrix type liquid crystal displays.

As shown in FIG. 1, because a liquid crystal display switches a data voltage supplied to liquid crystal cells Clc using a thin film transistor TFT formed in each of the liquid crystal cells Clc to actively control data, the image quality of a moving picture can increase. In FIG. 1, a reference numeral Cst indicates a storage capacitor for keeping a charging voltage of the liquid crystal cell Clc at the data voltage, DL a data line to which the data voltage is supplied, and GL a scan line to which a scan voltage is supplied.

The liquid crystal display is driven in an inversion manner in which polarities of the neighboring liquid crystal cells Clc are opposite to each other and polarities of the neighboring liquid crystal cells Clc are inverted every 1 frame period, so as to reduce direct current (DC) offset components and to reduce the degradation of liquid crystals. In the inversion manner, if the data voltage with a predetermined polarity is dominantly supplied to the liquid crystal cell Clc for a long time, image sticking occurs in the liquid crystal display. In the invention, because the image sticking occurs by repeatedly charging the liquid crystal cells Clc to a voltage with the same polarity, the image sticking is called direct current (DC) image sticking. For example, in case the data voltage is supplied to the liquid crystal cells Clc in an interlaced manner, the DC image sticking occurs. In the interlaced manner, the data voltage is supplied to the liquid crystal cells of only odd-numbered horizontal lines during odd-numbered frame periods, and the data voltage is supplied to the liquid crystal cells of only even-numbered horizontal lines during even-numbered frame periods.

FIG. 2 is a waveform diagram showing an example of the data voltage supplied to the same liquid crystal cells Clc in an interlaced manner during 1st to 4th frame periods.

As shown in FIG. 2, a positive data voltage is supplied to the liquid crystal cells Clc during odd-numbered frame periods, and a negative data voltage is supplied to the liquid crystal cells Clc during even-numbered frame periods. In the interlaced manner, a high positive data voltage is supplied to the liquid crystal cells Clc of the odd-numbered horizontal lines during only the odd-numbered frame periods. Therefore, as can be seen from the waveform diagram in a box area of FIG. 2, because the positive data voltage is supplied more dominantly than the negative data voltage during 4 frame periods, the DC image sticking appears.

FIG. 3 illustrates an experimental result of DC image sticking resulting from interlaced data. If an original image shown at a left side of FIG. 3 is displayed on the liquid crystal display in the interlaced manner for a predetermined period of time, the data voltage supplied to the liquid crystal cells Clc changes as shown in FIG. 2. As a result, after the predetermined period of time elapsed, if the data voltage with a middle gray level, for example, the data voltage with 127-gray level is supplied to the liquid crystal cells Clc of the entire screen, the original image is dimly displayed like an image shown at a right side of FIG. 3. Namely, the DC image sticking appears.

As another example of the DC image sticking, as shown in FIG. 4, if the same image moves or is scrolled at a predetermined speed, voltages of the same polarity are repeatedly accumulated on the liquid crystal cells Clc depending on a relationship between the size and a scrolling speed (moving speed) of the scrolled image. Hence, the DC image sticking may appear. FIG. 4 illustrates an experimental result of the DC image sticking appearing when an image having an oblique line pattern and a character pattern moves at a predetermined speed.

SUMMARY OF THE INVENTION

Embodiments of the invention provide a liquid crystal display and a method of driving the same capable of increasing display quality by preventing DC image sticking.

In one aspect, there is a liquid crystal display comprising a liquid crystal display panel including a plurality of data lines, a plurality of gate lines crossing the data lines, and a plurality of liquid crystal cells, the liquid crystal display panel having a quad type pixel structure in which red, green, blue, and white subpixels constitute one pixel, a logic circuit that sequentially outputs a plurality of polarity control signals, wherein a logic level of each of the polarity control signals is inverted every three horizontal periods, and phases of the polarity control signals are different from one another, a data drive circuit that inverts a polarity of a data voltage in response to the polarity control signals received from the logic circuit to supply the data voltage with the inverted polarity to the data lines, and a gate drive circuit that sequentially supplies gate pulses to the gate lines.

In another aspect, there is a method of driving a liquid crystal display including a liquid crystal display panel that includes a plurality of data lines, a plurality of gate lines crossing the data lines, and a plurality of liquid crystal cells and has a quad type pixel structure in which red, green, blue, and white subpixels constitute one pixel, the method comprising sequentially outputting a plurality of polarity control signals, wherein a logic level of each of the polarity control signals is inverted every three horizontal periods, and phases of the polarity control signals are different from one another, inverting a polarity of a data voltage in response to the polarity control signals to supply the data voltage with the inverted polarity to the data lines, and sequentially supplying gate pulses to the gate lines.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail embodiments of the invention examples of which are illustrated in the accompanying drawings.

FIGS. 5 to 12 illustrate a liquid crystal display according to an embodiment of the invention.

Figure 1:
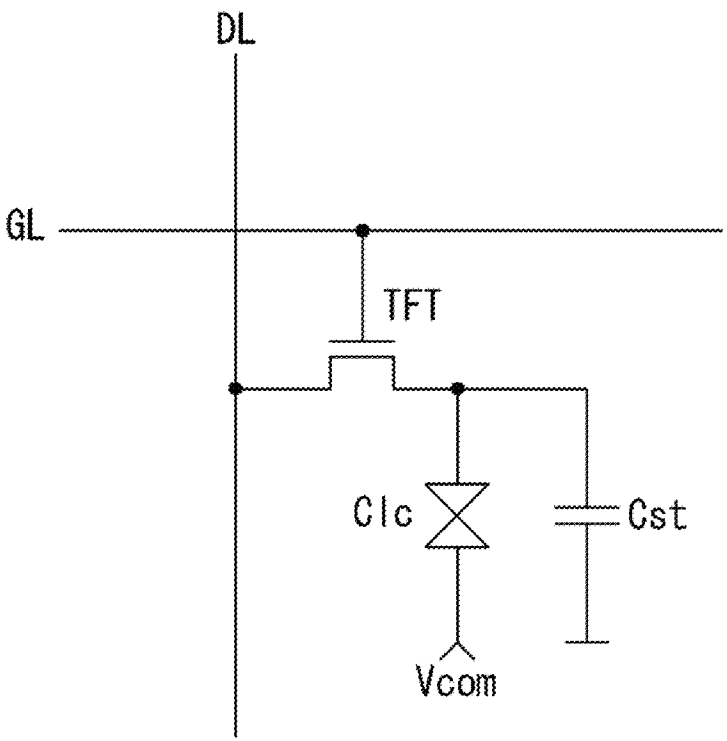
FIG. 1 (RELATED ART)
FIG. 1 is an equivalent circuit diagram of a liquid crystal cell of a liquid crystal display.
Figure 2:
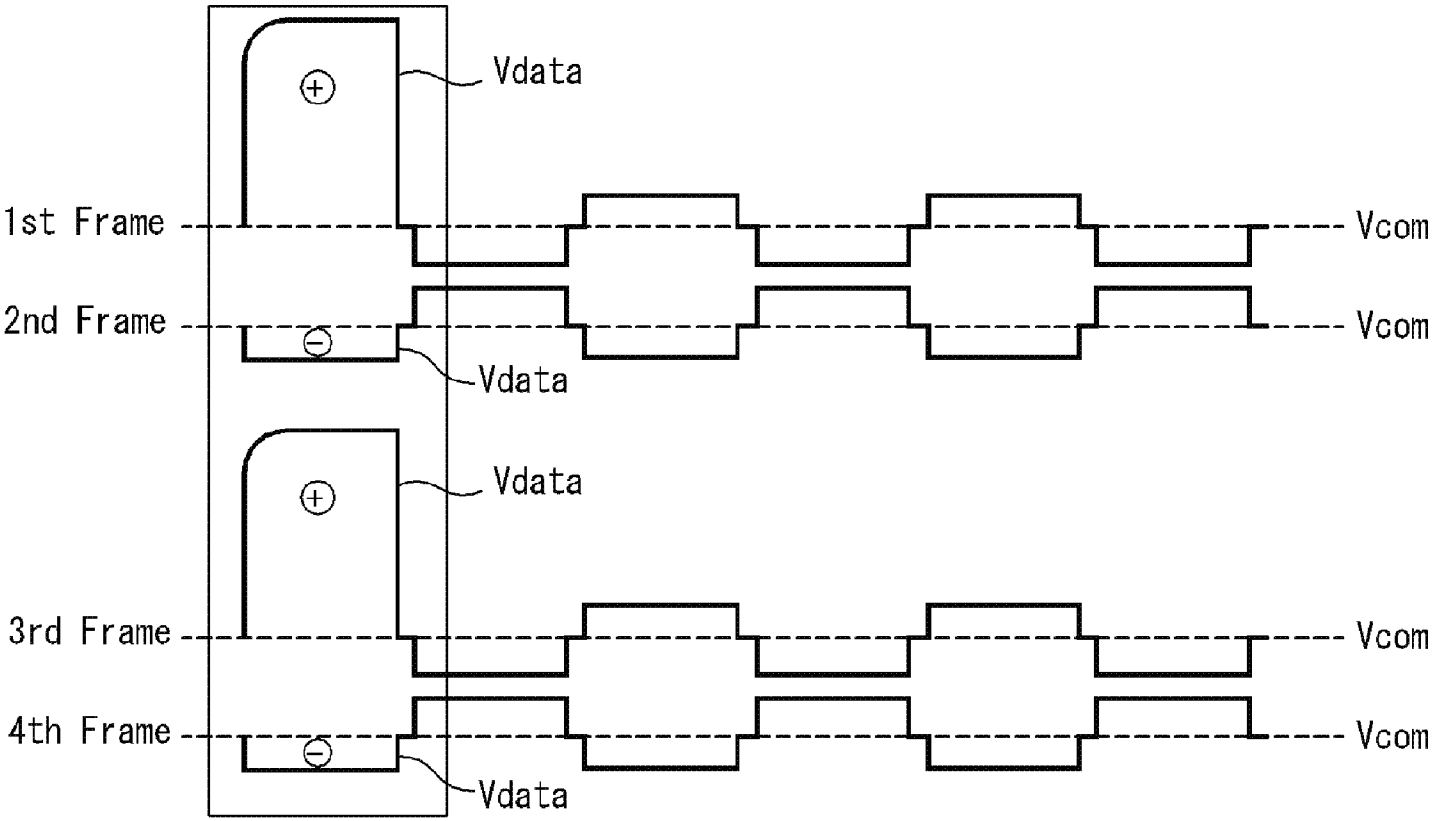
FIG. 2 (RELATED ART)
FIG. 2 is a waveform diagram illustrating an example of an interlaced manner.
Figure 3:
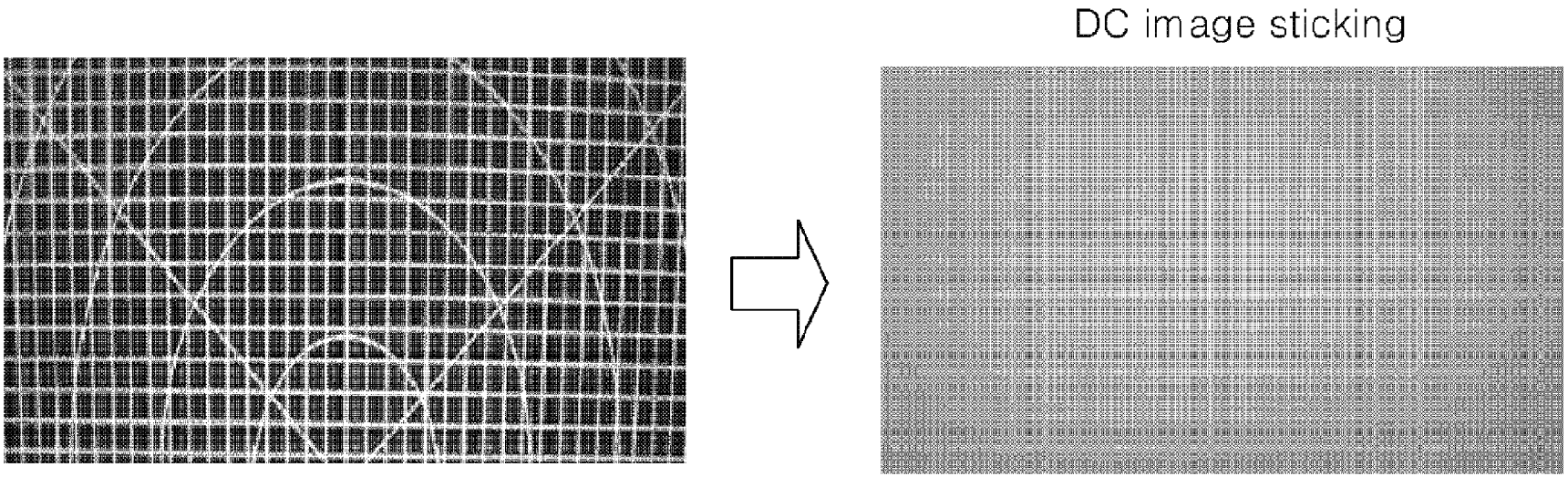
FIG. 3 (RELATED ART)
FIG. 3 illustrates an experimental result of DC image sticking resulting from interlaced data.
Figure 4:
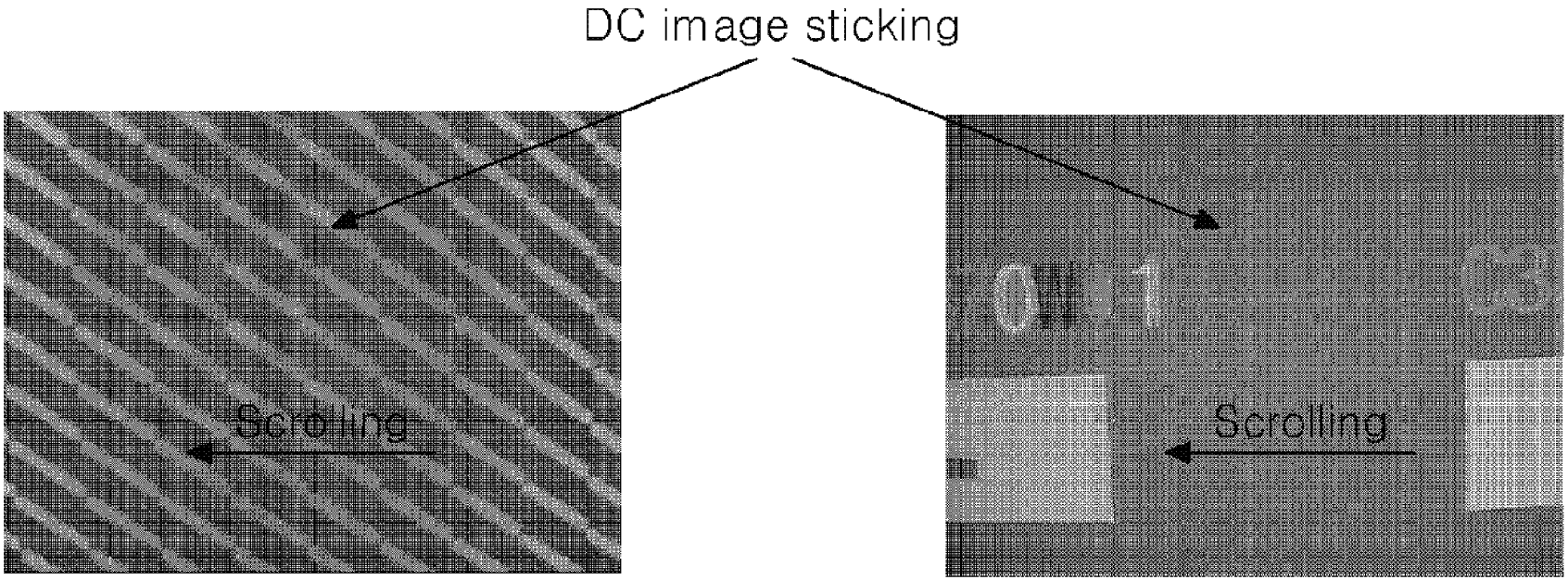
FIG. 4 (RELATED ART)
FIG. 4 illustrates an experimental result of DC image sticking resulting from scrolling data.
Figure 5:
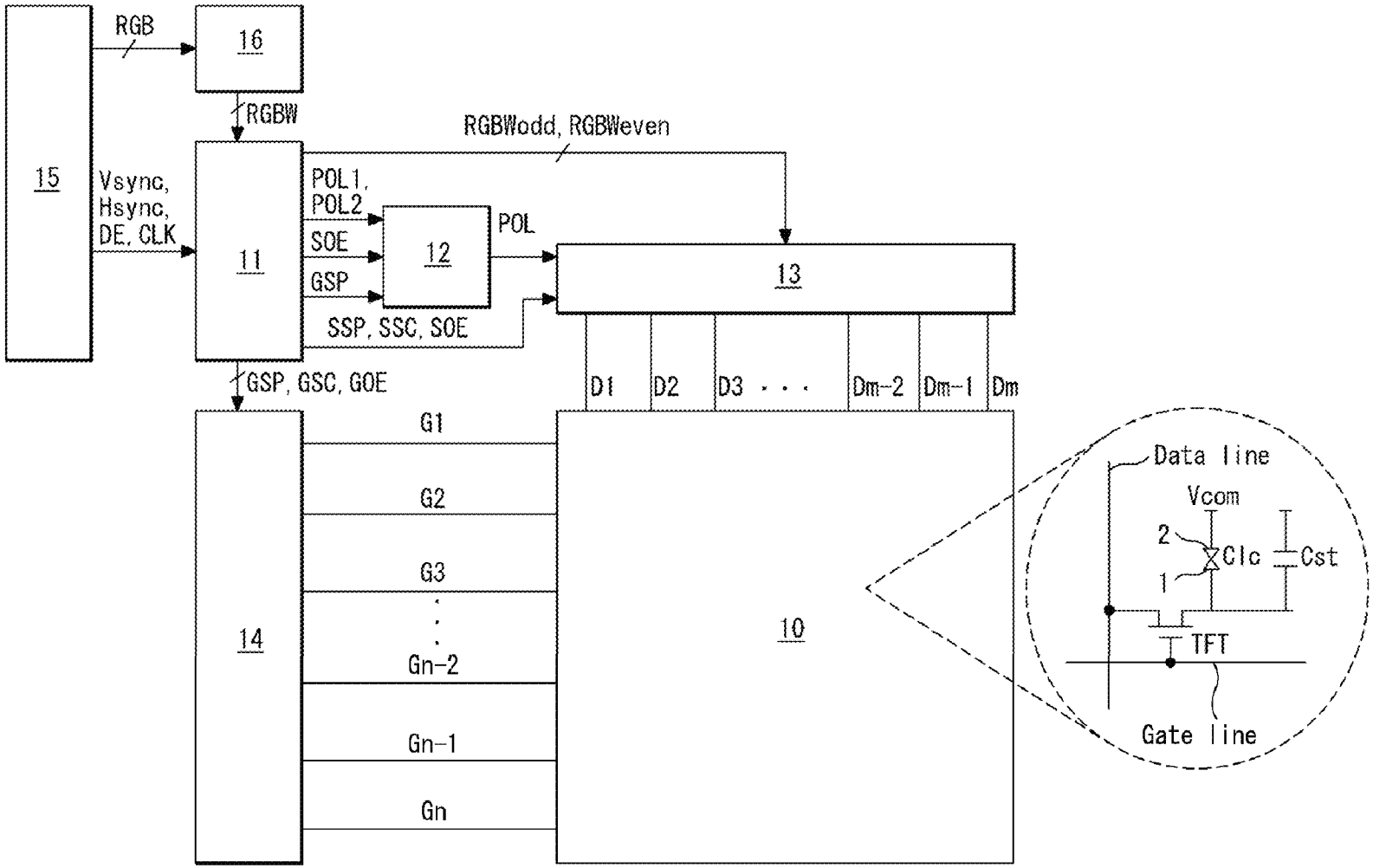
FIG. 5 is a block diagram illustrating an exemplary configuration of a liquid crystal display according to an embodiment of the invention.
Figure 6:
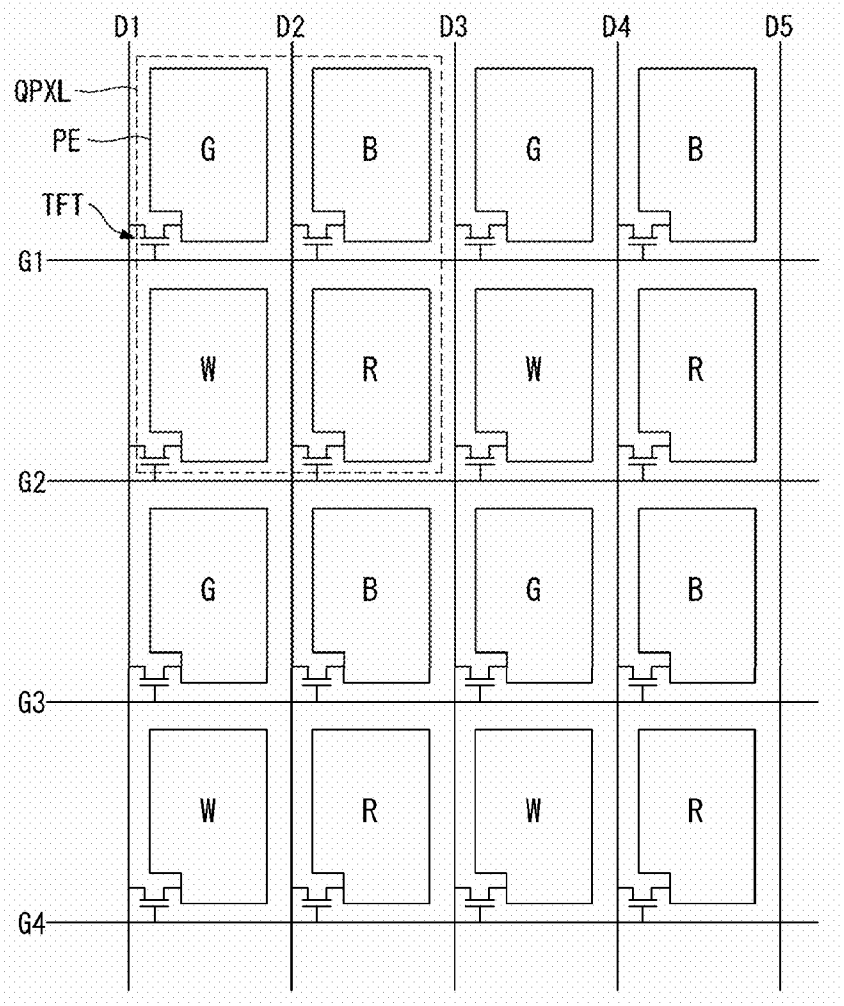
FIG. 6 is an equivalent circuit diagram illustrating quad type pixels in a pixel array of a liquid crystal display panel.

As shown in FIGS. 5 and 6, a liquid crystal display according to an embodiment of the invention includes a liquid crystal display panel 10, a video source 15, a data conversion circuit 16, a timing controller 11, a logic circuit 12, a data drive circuit 13, and a gate drive circuit 43.

The liquid crystal display panel 10 includes an upper glass substrate, a lower glass substrate, and a liquid crystal layer between the upper and lower glass substrates. The lower glass substrate of the liquid crystal display panel 10 includes m data lines D1 to Dm (where m is a positive integer) and n gate lines G1 to Gn (where n is a positive integer) crossing each other. The liquid crystal display panel 10 includes m×n liquid crystal cells Clc arranged at each of crossings of the m data lines D1 to Dm and the n gate lines G1 to Gn in a matrix format. The lower glass substrate further includes a thin film transistor TFT, a pixel electrode 1 of the liquid crystal cell Clc connected to the thin film transistor TFT, and a storage capacitor Cst, and the like. The storage capacitor Cst may be implemented as a storage-on-gate type storage capacitor or a storage-on-common type storage capacitor.

The upper glass substrate of the liquid crystal display panel 10 includes a black matrix, a color filter, and a common electrode 2. The common electrode 2 is formed on the upper glass substrate in a vertical electric drive manner, such as a twisted nematic (TN) mode and a vertical alignment (VA) mode. The common electrode 2 and the pixel electrode 1 are formed on the lower glass substrate in a horizontal electric drive manner, such as an in-plane switching (IPS) mode and a fringe field switching (FFS) mode. Polarizing plates each having optical axes that cross at a right angle are attached respectively to the upper and lower glass substrates. Alignment layers for setting a pre-tilt angle of the liquid crystals in an interface contacting the liquid crystals are respectively formed on the upper and lower glass substrates.

As shown in FIG. 6, a pixel array of the liquid crystal display panel 10 includes a plurality of quad type pixels QPXL arranged in a matrix format. In FIG. 6, PE indicates a pixel electrode of the liquid crystal cell Clc. Each of the quad type pixels QPXL includes G and B subpixels on an odd-numbered display line and W and R subpixels on an even-numbered display line. Each of the subpixels R, G, B, and W of the quad type pixels QPXL has a configuration of an equivalent circuit indicated in a circle of FIG. 5. A green color filter transmitting green light is formed in the G subpixel, a blue color filter transmitting blue light is formed in the B subpixel, and a red color filter transmitting red light is formed in the R subpixel. A color filter is not formed in the W subpixel. An organic or inorganic transparent layer transmitting light of all of wavelengths may be formed in the W subpixel.

The G subpixel includes a liquid crystal cell charged to a green data voltage received from odd-numbered data lines D1 and D3, and the B subpixel includes a liquid crystal cell charged to a blue data voltage received from even-numbered data lines D2 and D4. The W subpixel includes a liquid crystal cell charged to a white data voltage received from the odd-numbered data lines D1 and D3, and the R subpixel includes a liquid crystal cell charged to a red data voltage received from the even-numbered data lines D2 and D4. Accordingly, in the pixel array of the liquid crystal display panel 10, the G subpixel charged to the green data voltage from the odd-numbered data lines D1 and D3 and the B subpixel charged to the blue data voltage from the even-numbered data lines D2 and D4 are alternately positioned on the odd-numbered display lines in a repeated manner. Further, in the pixel array of the liquid crystal display panel 10, the W subpixel charged to the white data voltage from the odd-numbered data lines D1 and D3 and the R subpixel charged to the red data voltage from the even-numbered data lines D2 and D4 are alternately positioned on the even-numbered display lines in a repeated manner.

The video source 15 includes a broadcasting signal receiving circuit, an external equipment interface circuit, a graphic processing circuit, a line memory, and the like. The video source 15 extracts video data from an image source received from a broadcasting signal or an external equipment and converts the video data into digital data to supply the digital data to the timing controller 11. Interlaced data the video source 15 receives is stored in the line memory and then is supplied to the data conversion circuit 16 through an interface, such as a low voltage differential signaling (LVDS) interface and a transition minimized differential signaling (TMDS) interface. An interlaced image signal exists in only odd-numbered lines during odd-numbered frame periods and exists in only even-numbered lines during even-numbered frame periods. Accordingly, if the video source 15 receives interlaced data through the broadcasting signal receiving circuit, the video source 15 generates data of even-numbered lines during odd-numbered frame periods, in which data is not supplied to the even-numbered lines, and data of odd-numbered lines during even-numbered frame periods, in which data is not supplied to the odd-numbered line, using an average value of data or a black data value stored in the line memory during a previous frame period. Timing signals, such as vertical and horizontal sync signals Vsync and Hsync, a data enable signal DE, and a clock signal CLK generated by the video source 15 are supplied to the timing controller 11 through an interface, such as the LVDS interface and the TMDS interface.

The data conversion circuit 16 calculates a gain of white data through a predetermined white gain calculation algorism using data of three primary colors including red, green, and blue digital video data received from the video source 15 to produce the white data. The data conversion circuit 16 supplies red, green, blue, and white digital video data (hereinafter, referred to as RGBW data) to the timing controller 11. Any well-known white gain calculation algorism may be used. Examples of well-known white gain calculation algorism are disclosed in Korea Patent Application Nos. 10-2005-0039728 (May 12, 2005), 10-2005-0052906 (Jun. 20, 2005), 10-2005-0066429 (Jul. 21, 2005), and 10-2006-0011292 (Feb. 6, 2006) already filed by the present applicant.

Figure 9:
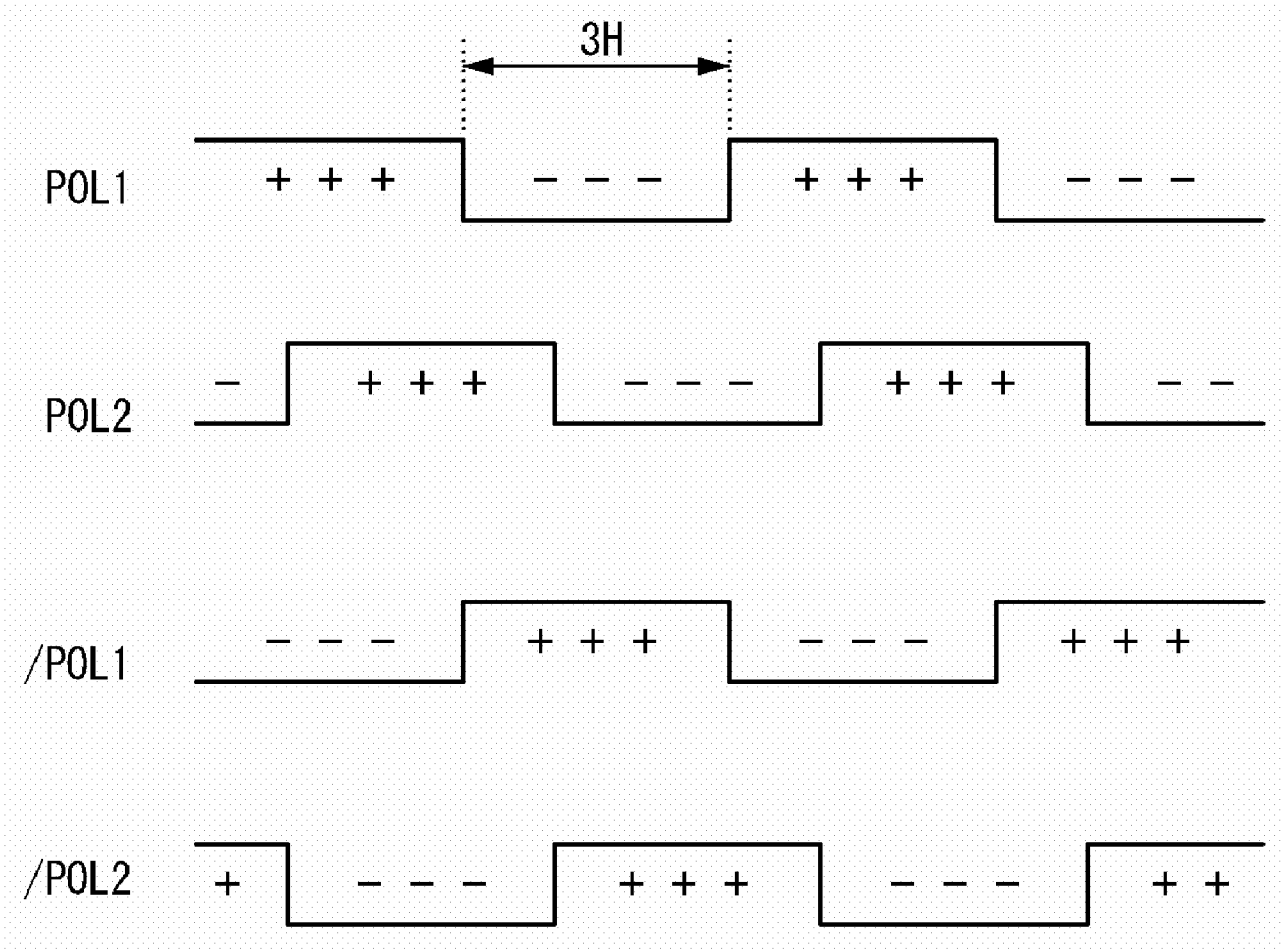
FIG. 9 is a waveform diagram illustrating polarity control signals.

The timing controller 11 divides RGBW data RGBW received from the data conversion circuit 16 into odd pixel data RGBWodd and even pixel data RGBWeven so as to lower a transmission frequency of digital video data. The timing controller 11 supplies the data RGBWodd and RGBWeven to the data drive circuit 13 through 6 data buses in a mini LVDS interface manner in synchronization with timing control signals for controlling operation timing of the data drive circuit 13 and operation timing of the gate drive circuit 14. The timing controller 11 receives the timing signals, such as the vertical and horizontal sync signals Vsync and Hsync, the data enable signal DE, and the clock signal CLK from the video source 15 and generates timing control signals for controlling operation timings of the data drive circuit 13, the gate drive circuit 14, and the logic circuit 12. The timing control signals generated by the timing controller 11 include a data timing control signal for controlling the operation timing of the data drive circuit 13 and a gate timing control signal for controlling the operation timing of the gate drive circuit 14. The gate timing control signal includes a gate start pulse GSP, a gate shift clock signal GSC, a gate output enable signal GOE, and the like. The gate start pulse GSP controls a start horizontal line of a scan operation during 1 vertical period in which one screen is displayed. The gate shift clock signal GSC is a clock signal that is input to a shift resistor inside the gate drive circuit 14 to sequentially shift the gate start pulse GSP. The gate output enable signal GOE controls output timing of the gate drive circuit 14. The data timing control signal includes a source start pulse SSP, a source sampling clock signal SSC, a source output enable signal SOE, and first and second polarity control signals POL1 and POL2. The source start pulse SSP controls a start pixel in 1 horizontal line to which data will be displayed. The source sampling clock signal SSC controls a data latch operation inside the data drive circuit 13 based on a rising or falling edge. The source output enable signal SOE controls output timing of the data drive circuit 13. Each of the first and second polarity control signals POL1 and POL2 allows a data voltage of the same polarity to be sequentially supplied to the liquid crystal cells Clc on three neighboring display lines and controls a polarity of the data voltage to be supplied to the liquid crystal cells Clc so that a polarity of the data voltage supplied to the liquid crystal cells Clc is inverted every three display lines. For this, as shown in FIG. 9, a logic level of each of the first and second polarity control signals POL1 and POL2 is inverted every about 3 horizontal periods, and there is a phase difference of about 1 horizontal period between the first and second polarity control signals POL1 and POL2.

The logic circuit 12 receives the gate start pulse GSP and decides a frame period of a presently displayed image. As shown in FIG. 9 and FIGS. 17A to 17D, the logic circuit 12 sequentially outputs a plurality of polarity control signals POL1, POL2,/POL1, and /POL2 that have the same logic inversion period and different phases.

The logic circuit 12 and the data conversion circuit 16 may be installed inside the timing controller 11.

Figure 10:
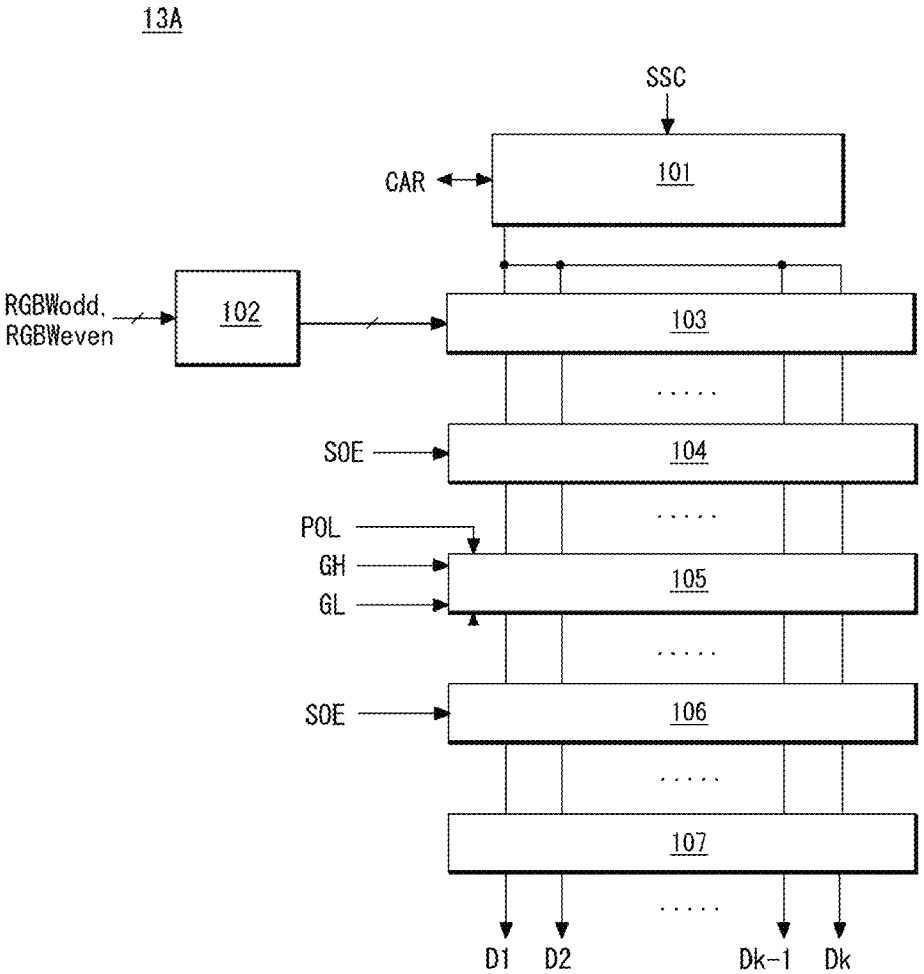
FIG. 10 is a block diagram illustrating a data drive integrated circuit (IC)
Figure 11:
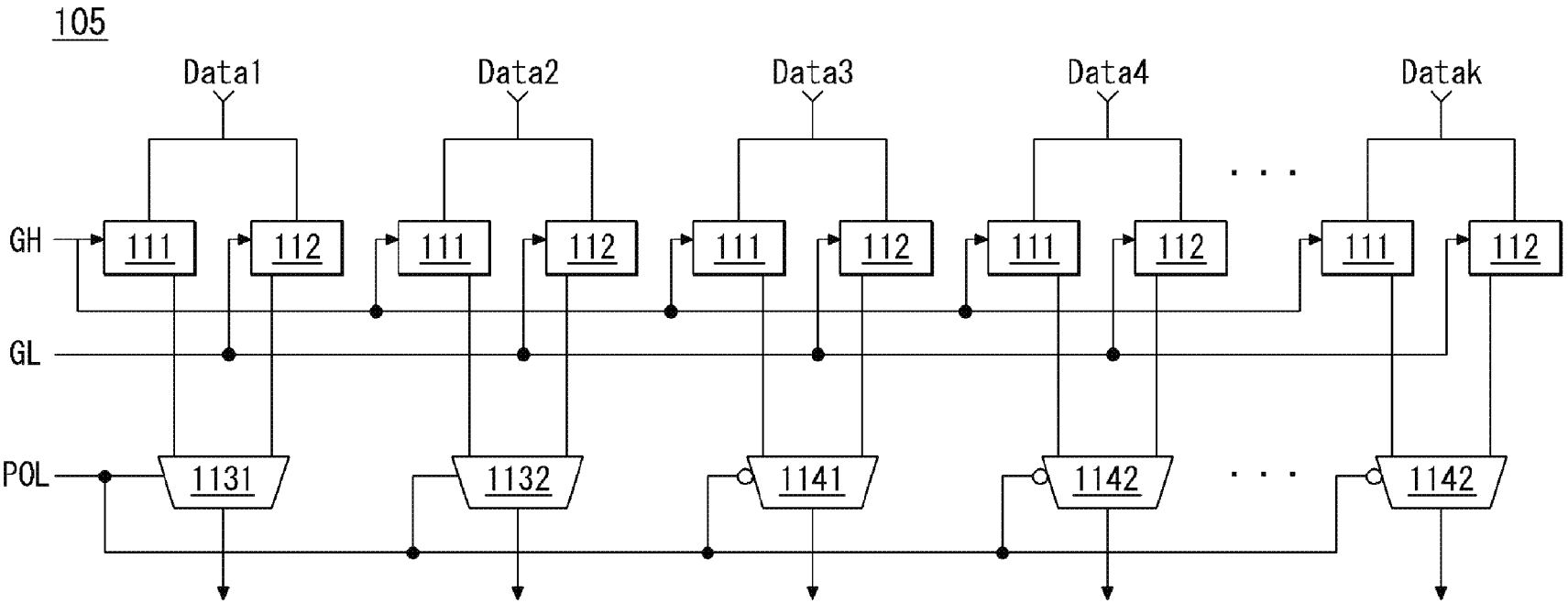
FIG. 11 is a circuit diagram illustrating a digital-to-analog converter.

The data drive circuit 13 has a circuit configuration shown in FIGS. 10 and 11 and includes a plurality of cascade-connected data drive integrated circuits (ICs). The data drive circuit 13 latches the RGBW data RGBWodd and RGBWeven under the control of the timing controller 11 and converts the RGBW data RGBWodd and RGBWeven into analog positive and negative gamma compensation voltages to generate the analog positive and negative gamma compensation voltages. The data drive circuit 13 converts a polarity of the data voltage in response to the polarity control signal POL from the logic circuit 12 and supplies a positive RGBW data voltage and a negative RGBW data voltage to the data lines D1 to Dm.

Figure 12:
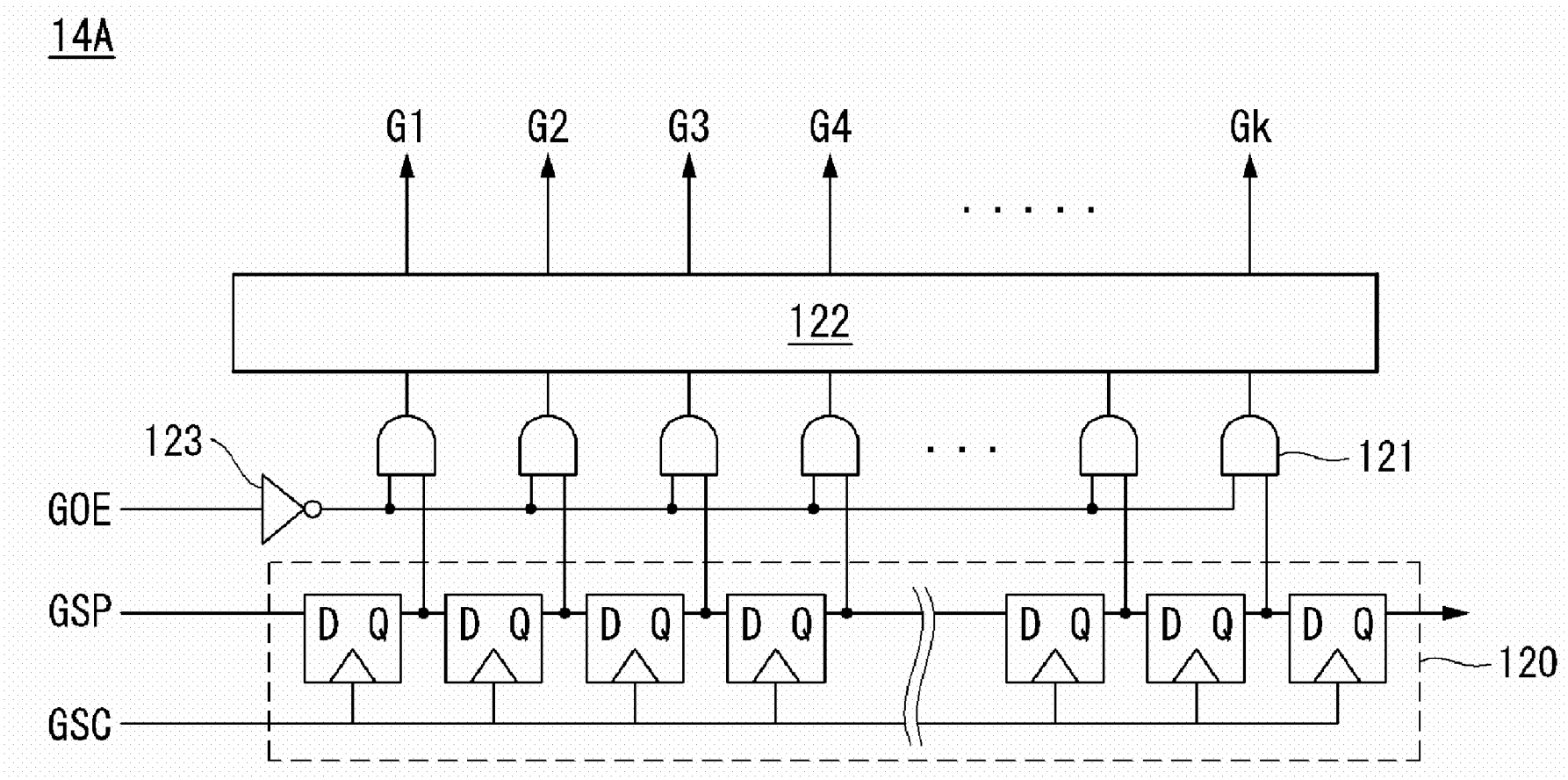
FIG. 12 is a circuit diagram illustrating a gate drive IC.

The gate drive circuit 14 has a circuit configuration shown in FIG. 12 and includes a plurality of cascade-connected gate drive ICs. The gate drive circuit 14 sequentially outputs gate pulses (i.e., scan pulses) each having a pulse width of about 1 horizontal period under the control of the timing controller 11. Accordingly, the gate drive circuit 14 sequentially supplies the gate pulses to the gate lines G1 to Gn of the liquid crystal display panel 10. The TFTs of the pixel array of the liquid crystal display panel 10 are turned on in response to the gate pulses from the gate lines G1 to Gn to supply the data voltage from the data lines D1 to Dm to the pixel electrodes 1. For this, gate electrodes, source electrodes, and drain electrodes of the TFTs are connected to the gate lines G1 to Gn, the data lines D1 to Dm, and the pixel electrodes 1, respectively.

The liquid crystal display applicable to the invention may be implemented in any liquid crystal mode as well as the TN, VA, IPS, and FFS modes. The liquid crystal display according to the invention may be implemented in any type liquid crystal display including a backlit liquid crystal display, a transflective liquid crystal display, and a reflective liquid crystal display. A backlight unit that is omitted in the drawings is necessary in the backlit liquid crystal display and the transflective liquid crystal display.

Figure 7:
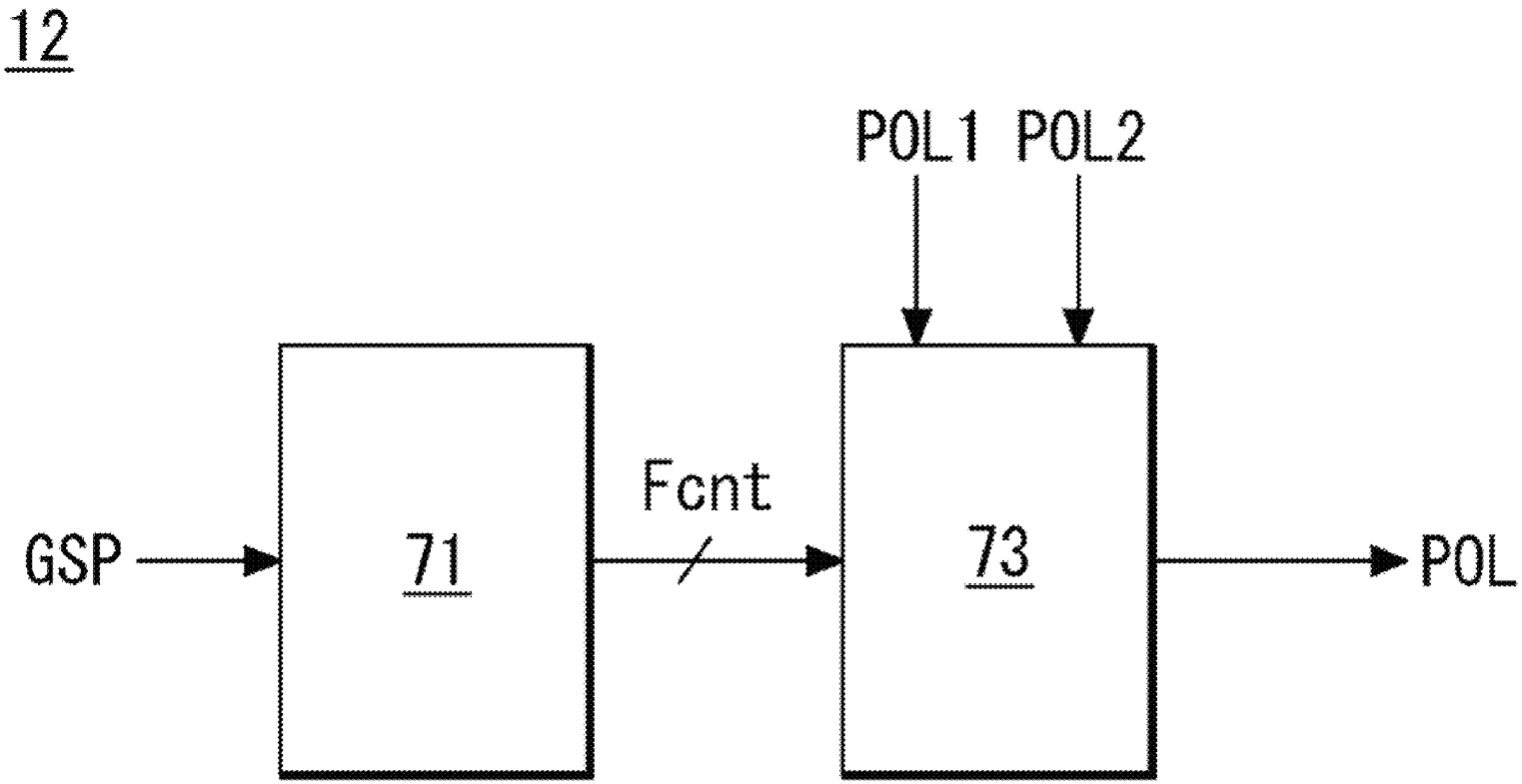
FIG. 7 is a block diagram illustrating a logic circuit.
Figure 8:
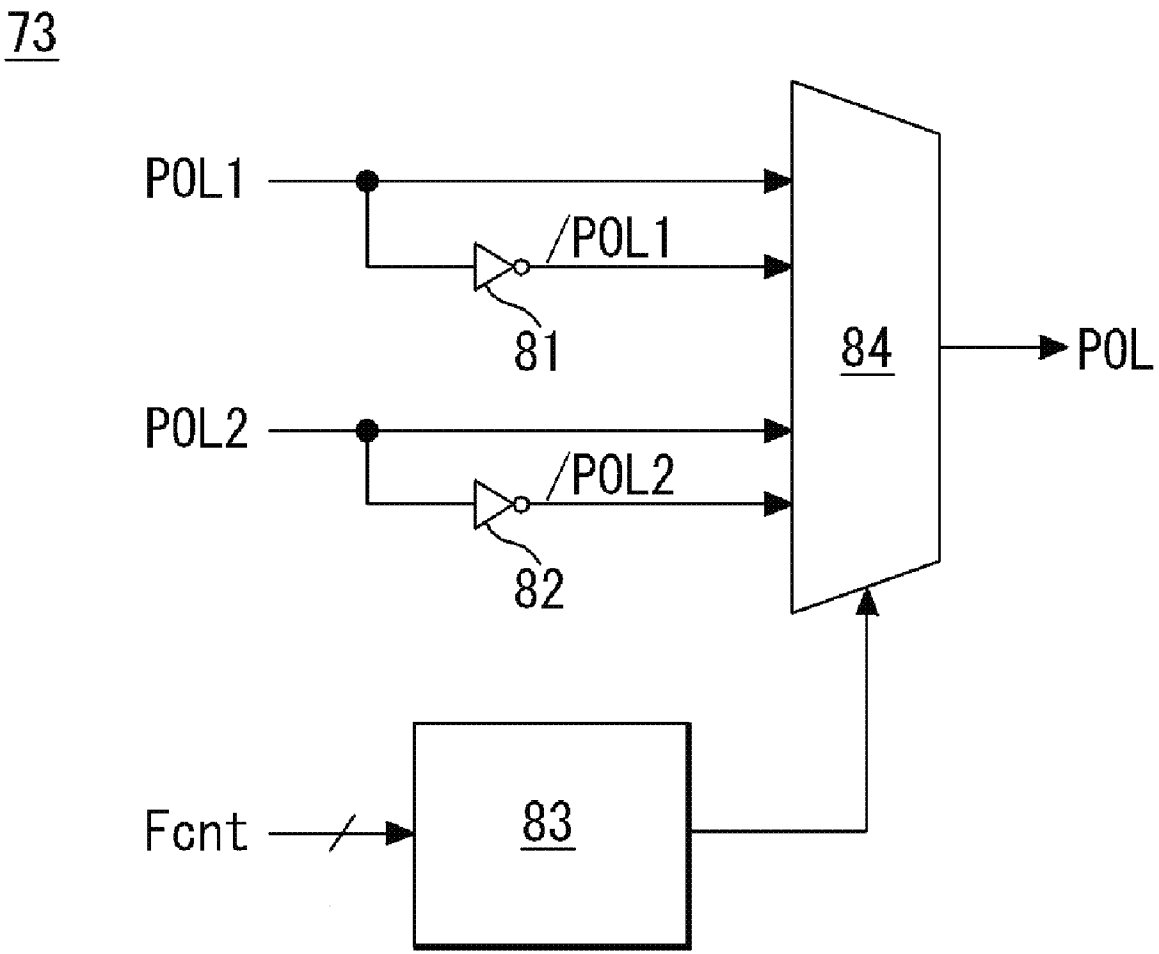
FIG. 8 is a block diagram illustrating a POL selection circuit.

FIGS. 7 and 8 are circuit diagrams of the logic circuit 12.

As shown in FIGS. 7 and 8, the logic circuit 12 includes a frame counter 71 and a POL selection circuit 73.

The frame counter 71 outputs a frame count information Fcnt indicating a number of frame periods of an image to be displayed on the liquid crystal display panel 10 in response to the gate start pulse GSP that is once generated during 1 frame period and is generated simultaneous with a start of 1 frame period.

The POL selection circuit 73 sequentially outputs the 4 polarity control signals POL1, POL2, /POL1, and /POL2, which rotate every 4 frame periods, depending on the frame count information Fcnt. The polarity control signals POL1, POL2, /POL1, and /POL2 include a first polarity control signal POL1 controlling a polarity of the data voltage output by the data drive circuit 13 during an N-th frame period (where N is a positive integer), a second polarity control signal POL2 controlling a polarity of the data voltage output by the data drive circuit 13 during an (N+1)th frame period, a first inversion polarity control signal /POL1 controlling a polarity of the data voltage output by the data drive circuit 13 during an (N+2)th frame period, and a second inversion polarity control signal /POL2 controlling a polarity of the data voltage output by the data drive circuit 13 during an (N+3)th frame period. The polarity control signals POL1, POL2, /POL1, and /POL2 control a polarity of the data voltage supplied to the liquid crystal cells Clc and have an optimum phase obtained by repeatedly conducting an experiment on the liquid crystal display panel 10 having the quad type pixel structure, so that DC image sticking, flicker, and color distortion are not generated in the liquid crystal display panel 10 having the quad type pixel structure shown in FIG. 6. Specifically describing the polarity control signals POL1, POL2, /POL1, and /POL2 each having the optimum phase through the experiments, as shown in FIG. 9, a phase of the second polarity control signal POL2 generated subsequent to the first polarity control signal POL1 is more delayed than a phase of the first polarity control signal POL1 by about 1 horizontal period. Further, a phase of the first inversion polarity control signal /POL1 generated subsequent to the second polarity control signal POL2 is more delayed than a phase of the second polarity control signal POL2 by about 2 horizontal periods, and a phase of the second inversion polarity control signal POL2 generated subsequent to the first inversion polarity control signal /POL1 is more delayed than a phase of the first inversion polarity control signal /POL1 by about 1 horizontal period. A phase of the first polarity control signal POL1 again generated subsequent to the second inversion polarity control signal /POL2 is more delayed than a phase of the second inversion polarity control signal /POL2 by about 2 horizontal periods.

The POL selection circuit 73 includes first and second inverters 81 and 82, a frame controller 83, a multiplexer 84, and the like, and generates polarity control signals shown in FIG. 9 and FIGS. 17A to 17D.

The first inverter 81 inverts the first polarity control signal POL1 to generate the first inversion polarity control signal /POL1 that is out of phase with the first polarity control signal POL1. The second inverter 82 inverts the second polarity control signal POL2 to generate the second inversion polarity control signal /POL2 that is out of phase with the second polarity control signal POL2.

The frame controller 83 receives the frame count information Fcnt from the frame counter 71 and decides a frame period of a presently displayed image. The frame controller 83 generates a selection signal for controlling the multiplexer 84 depending on a decision result of the frame period.

As shown in FIGS. 17A to 17D, the multiplexer 84 supplies the first polarity control signal POL1 to the data drive circuit 13 during an N-th frame period and then supplies the second polarity control signal POL2 to the data drive circuit 13 during an (N+1)th frame period under the control of the frame controller 83. Subsequently, the multiplexer 84 supplies the first inversion polarity control signal /POL1 to the data drive circuit 13 during an (N+2)th frame period and then supplies the second inversion polarity control signal /POL2 to the data drive circuit 13 during an (N+3)th frame period under the control of the frame controller 83.

FIGS. 10 and 11 are circuit diagrams illustrating data drive ICs.

As shown in FIGS. 10 and 11, each of data drive ICs 13A drives k data lines (k is a positive integer smaller than m) and includes a shift register 101, a data restoring unit 102, a first latch array 103, a second latch array 104, a digital-to-analog converter (DAC) 105, a charge share circuit 106, and an output circuit 107.

The data restoring unit 102 restores the digital video data RGBWodd and RGBWeven received from the timing controller 11 in the mini LVDS manner to supply the digital video data RGBWodd and RGBeven to the first latch array 103.

The shift register 101 shifts sampling signals depending on the source sampling clock signal SSC. When data exceeding a number of latch operations in the first latch array 103 is supplied, the shift register 101 generates a carry signal CAR.

The first latch array 103 samples and latches the digital video data RGBWodd and RGBWeven from the data restoring unit 102 in response to the sampling signals sequentially received from the shift register 101 and then simultaneously outputs the digital video data RGBWodd and RGBWeven.

The second latch array 104 latches the digital video data RGBWodd and RGBWeven received from the first latch array 103. Then, the second latch array 104 and the second latch arrays 104 of the other data drive ICs 13A simultaneously output the latched digital video data RGBWodd and RGBWeven during a low logic period of the source output enable signal SOE.

The DAC 105, as shown in FIG. 11, includes a P-decoder 111 receiving the positive gamma compensation voltage, an N-decoder 112 receiving the negative gamma compensation voltage, and multiplexers 1131, 1132, 1141, and 1142 selecting an output of the P-decoder 111 and an output of the N-decoder 112.

The P-decoder 111 decodes data received from the second latch array 104 and outputs a positive gamma compensation voltage GH corresponding to a gray level of the data as the data voltage. The N-decoder 112 decodes data received from the second latch array 104 and outputs a negative gamma compensation voltage GL corresponding to a gray level of the data as the data voltage.

The multiplexers 1131, 1132, 1141, and 1142 include a first multiplexer 1131 selecting a data voltage to be supplied to (4i+1)th data lines D1, D5, . . . , Dm-3 (where i is an integer equal to or greater than 0), a second multiplexer 1132 selecting a data voltage to be supplied to (4i+2)th data lines D2, D6, . . . , Dm-2, a third multiplexer 1141 selecting a data voltage to be supplied to (4i+3)th data lines D3, D7, . . . , Dm-1, and a fourth multiplexer 1142 selecting a data voltage to be supplied to (4i+4)th data lines D4, D8, . . . , Dm. While the polarity control signal POL received from the logic circuit 12 is input to control terminals of the first and second multiplexers 1131 and 1132 without an inversion, the polarity control signal POL received from the logic circuit 12 is inverted and then input to control terminals of the third and fourth multiplexers 1141 and 1142. Accordingly, the first and second multiplexers 1131 and 1132 alternately select the positive data voltage and the negative data voltage output by the P-decoder 111 and the N-decoder 112 every about 3 horizontal periods in response to the polarity control signal POL. On the other hand, the third and fourth multiplexers 1141 and 1142 alternately select the positive data voltage and the negative data output by the P-decoder 111 and the N-decoder 112 every about 3 horizontal periods in response to the inverted polarity control signal POL. As a result, a polarity of the data voltage supplied to the (4i+1)th and (4i+2)th data lines is opposite to a polarity of the data voltage supplied to the (4i+3)th and (4i+4)th data lines.

The charge share circuit 106 shorts neighboring data output channels to output an average value of the neighboring data voltages as a charge share voltage during a high logic period of the source output enable signal SOE. Otherwise, during the high logic period of the source output enable signal SOE, the charge share circuit 106 supplies a common voltage Vcom to data output channels to reduce a change in a sharp swing width between the positive and negative data voltages to be supplied to the data lines D1 to Dm. The output circuit 107 minimizes a signal attenuation of the data voltage supplied to the data lines D1 to Dm using a buffer.

FIG. 12 is a circuit diagram illustrating the gate drive IC.

As shown in FIG. 12, a gate drive IC 14A includes a shift register 120, a level shifter 122, a plurality of AND gates 121 connected between the shift register 120 and the level shifter 122, and an inverter 123 inverting the gate output enable signal GOE.

The shift register 120 sequentially shifts the gate start pulse GSP depending on the gate shift clock signal GSC using a plurality of cascade-connected D flip-flops. Each of the AND gates 121 implements AND operation on an output signal of the shift register 120 and an inversion signal of the gate output enable signal GOE to generate an output. The inverter 123 inverts the gate output enable signal GOE and supplies the inverted gate output enable signal GOE to the AND gates 121. Accordingly, the gate drive IC 14A outputs a high logic voltage of the gate pulse during a low logic period of the gate output enable signal GOE.

The level shifter 122 shifts a swing width of an output voltage of the AND gates 121 within the range of an operation voltage of the TFTs in the pixel array of the liquid crystal display panel 10. Output signals G1 to Gk of the level shifter 122 are sequentially supplied to the k gate lines. The level shifter 122 is positioned in the front of the shift register 120, and the shift register 120 may be directly positioned on the glass substrate of the liquid crystal display panel 10.

Figure 13:
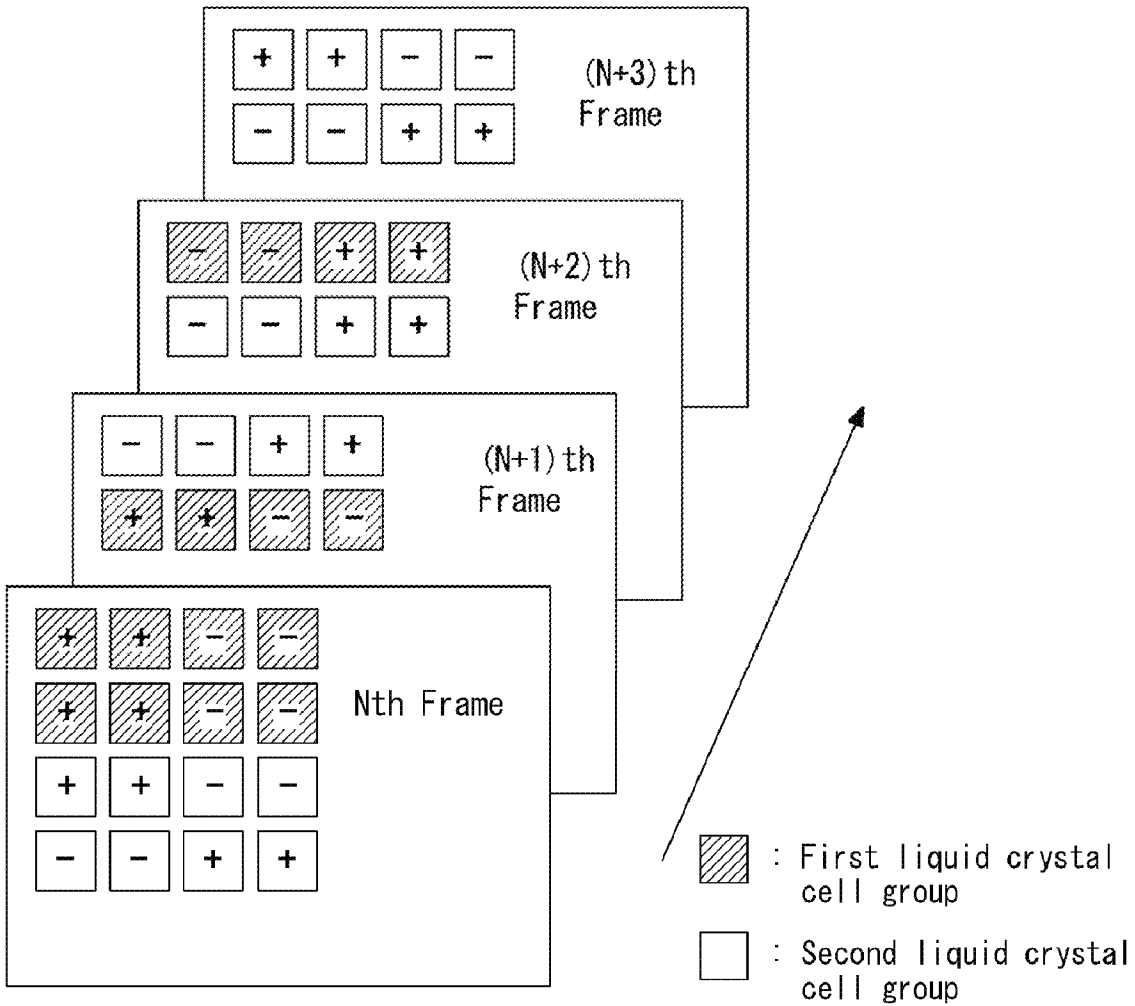
FIG. 13 is a diagram for explaining a principle in which DC image sticking in scrolling data is prevented through a method of driving the liquid crystal display according to the embodiment of the invention.
Figure 14:
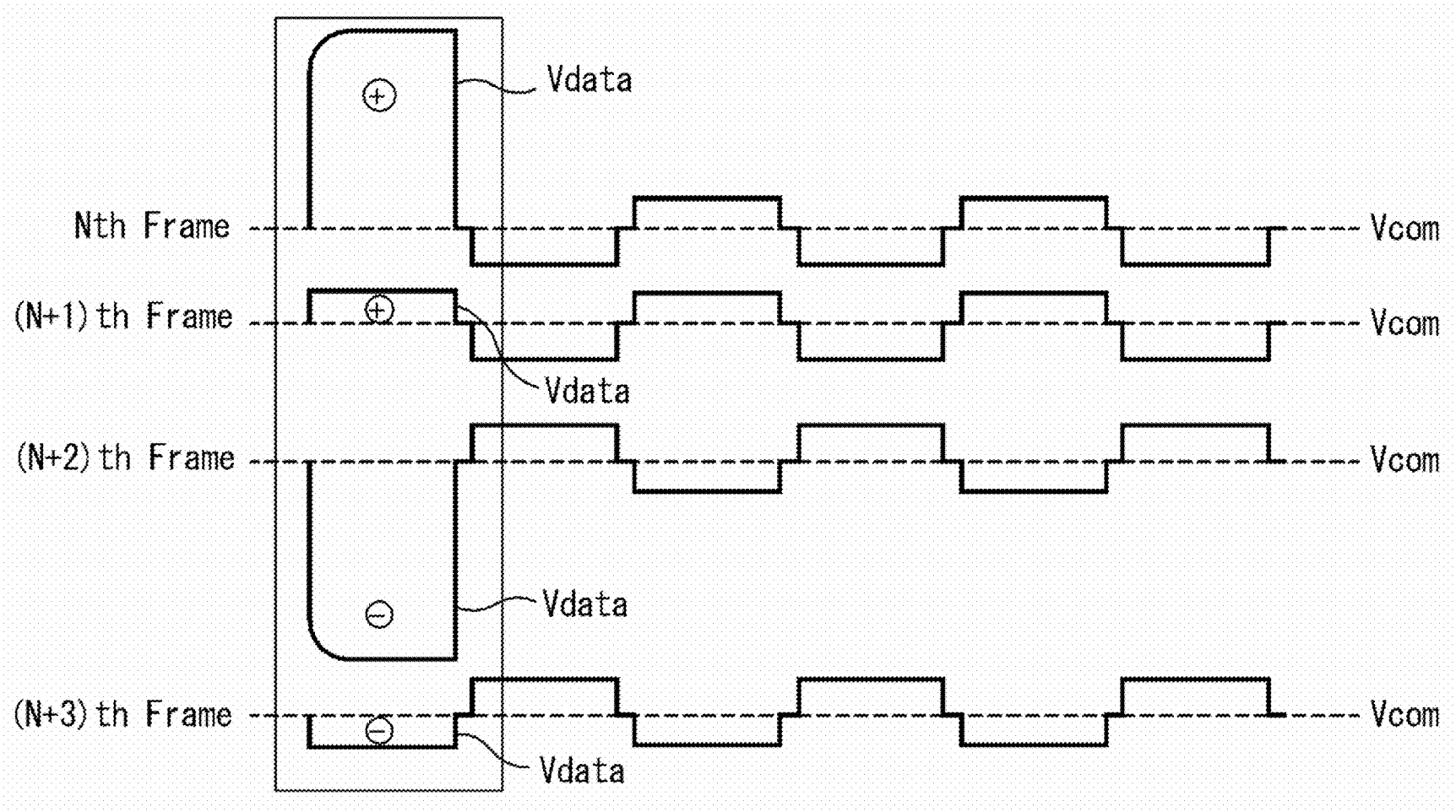
FIG. 14 is a waveform diagram illustrating DC prevention of liquid crystals in interlaced data.

FIGS. 13 and 14 are diagrams explaining a principle in which the DC image sticking and the flicker are prevented in the liquid crystal display according to the embodiment of the invention.

As shown in FIGS. 13 and 14, in the embodiment of the invention, inversion time points of polarities of the data voltages supplied to the neighboring liquid crystal cells are different from one another using the polarity control signal POL shown in FIG. 9. The liquid crystal cells Clc includes a first liquid crystal cell group charged to the data voltages having the same polarity as a polarity of the data voltages, that were charged during a previous frame period, during a current frame period and a second liquid crystal cell group charged to the data voltages having a polarity opposite a polarity of the data voltages, that were charged during the previous frame period, during the current frame period. Accordingly, liquid crystal cells belonging to the first liquid crystal cell group are charged to the data voltages having the same polarity during two frame periods. On the other hand, a polarity of the data voltage supplied to liquid crystal cells belonging to the second liquid crystal cell group is inverted once during two frame periods. A location of the liquid crystal cells belonging to the first liquid crystal cell group and a location of the liquid crystal cells belonging to the second liquid crystal cell group change as shown in FIGS. 17A to 17D.

When a video signal is supplied to the liquid crystal display panel 10 in the interlaced manner, the liquid crystal cells Clc are charged to the data voltage having a polarity shown in FIG. 14.

When interlaced data, in which a high data voltage is supplied to the liquid crystal cells during odd-numbered frame periods, is to be displayed on the liquid crystal display, as shown in FIG. 14, the liquid crystal cells of the first and second liquid crystal cell groups are charged to the data voltage whose a polarity is inverted every 2 frame periods. As a result, as shown in a box area of FIG. 14, the positive data voltages supplied to the liquid crystal cells during N-th and (N+1)th frame periods and the negative data voltages supplied to the same liquid crystal cells during (N+2)th and (N+3)th frame periods are neutralized with each other, and thus a polarity bias of the data voltages does not appear in the liquid crystal cells. The polarity bias means that the liquid crystal cells are more dominantly charged to the data voltages with one polarity of two polarities than the data voltages with the other polarity. For example, the liquid crystal cells are dominantly charged to the positive data voltages or the negative data voltages. Accordingly, when the interlaced data is supplied to the liquid crystal display according to the embodiment of the invention, DC image sticking can be prevented by preventing a DC phenomenon of liquid crystals.

When scrolling data, in which a symbol or a character moves at a speed of 8-pixel every 1 frame period, is to be displayed on the liquid crystal display, a voltage of the liquid crystal cells is inverted every 2 frame periods. Accordingly, in the scrolling data, in which a symbol or a character moves at a constant speed, the DC image sticking appearing by accumulating the data voltages with the same polarity can be prevented by periodically inverting a polarity of the data voltage supplied to the liquid crystal cells.

While the DC image sticking is prevented in the first liquid crystal cell group, the flicker may appear in the first liquid crystal cell group because the data voltages of the same polarity are supplied to the liquid crystal cells Clc every 2 frame periods. Because the data voltages whose polarities are inverted every 1 frame period are supplied to the liquid crystal cells Clc of the second liquid crystal cell group, the flicker generated in the first liquid crystal cell group can be minimized. This is because if a user watches the liquid crystal display, in which the first and second liquid crystal cell groups each having a different driving frequency exist together, with his or her eyes sensitive to changes, the user perceives the driving frequency of the second liquid crystal cell group greater than the driving frequency of the first liquid crystal cell group as the driving frequency of the first liquid crystal cell group.

If a liquid crystal display panel having a general pixel structure composed of three primary colors is driven in an inversion manner, flicker and color distortion of the liquid crystal display panel are reduced to the minimum in horizontal and vertical directions of the liquid crystal display panel. Therefore, it is preferable that a horizontal 1 dot and vertical 1 dot inversion manners are used. However, in the quad type liquid crystal display according the embodiment of the invention, if polarities of the data voltages change in a horizontal 1 dot inversion manner or a vertical 1 dot inversion manner, flicker and color distortion may appear because of the polarity bias of the data voltages even if the phase of the polarity control signal change every 1 frame period as shown in FIG. 9. This is described with reference to FIGS. 15 and 16.

Figure 15:
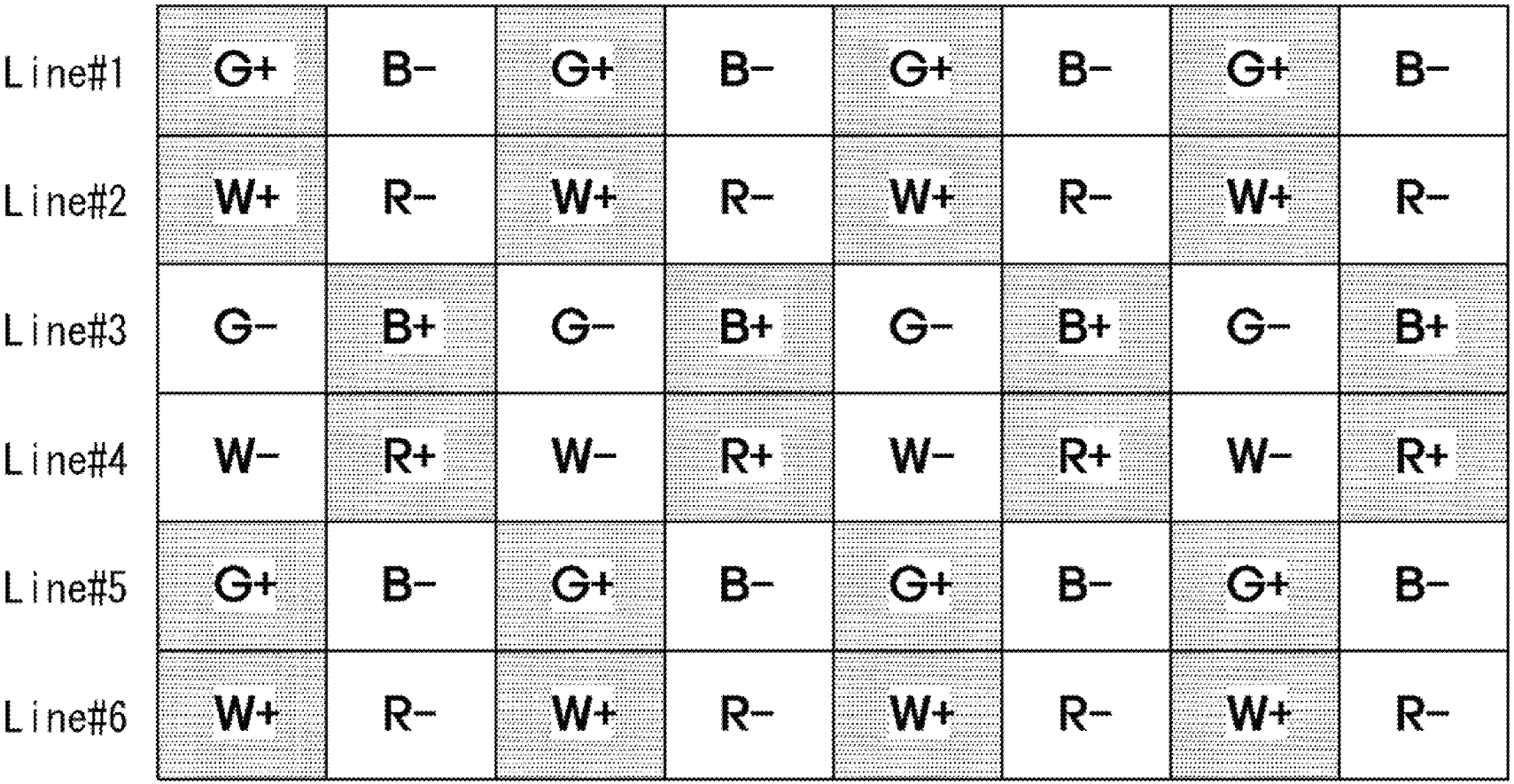
FIG. 15 illustrates an example where a data voltage, whose a polarity is inverted in vertical 2 dot and horizontal 1 dot inversion manners, is supplied to a liquid crystal display having a quad type pixel structure.

When liquid crystal cells are charged to positive and negative data voltages of the same gray level, charging amounts of the positive and negative data voltages are different from each other because of a kickback voltage resulting from a parasitic capacitance of the TFT. Generally, a charging amount of the negative data voltage is greater than a charging amount of the positive data voltage. Considering such a difference, as shown in FIG. 15, if data voltages, whose polarities are inverted in vertical 2 dot and horizontal 1 dot inversion manners, are supplied to liquid crystal cells of a liquid crystal display panel having a quad type pixel structure, a magenta image, in which blue and red are relatively strongly shown, is displayed on display lines Line #1, Line #2, Line #5, and Line #6. On the other hand, a greenish image, in which green and white are relatively strongly shown, is displayed on display lines Line #3 and Line #4. Namely, the color distortion may appear. Further, because green and white are relatively strongly shown in the display lines Line #3 and Line #4, a luminance in the display lines Line #3 and Line #4 is greater than a luminance in the display lines Line #1, Line #2, Line #5, and Line #6. Hence, the flicker may appear every two display lines. Namely, the color distortion and the flicker appear because the liquid crystal cells of the same color subpixels on the same display line are charged to the data voltages with the same polarity.

Figure 16:
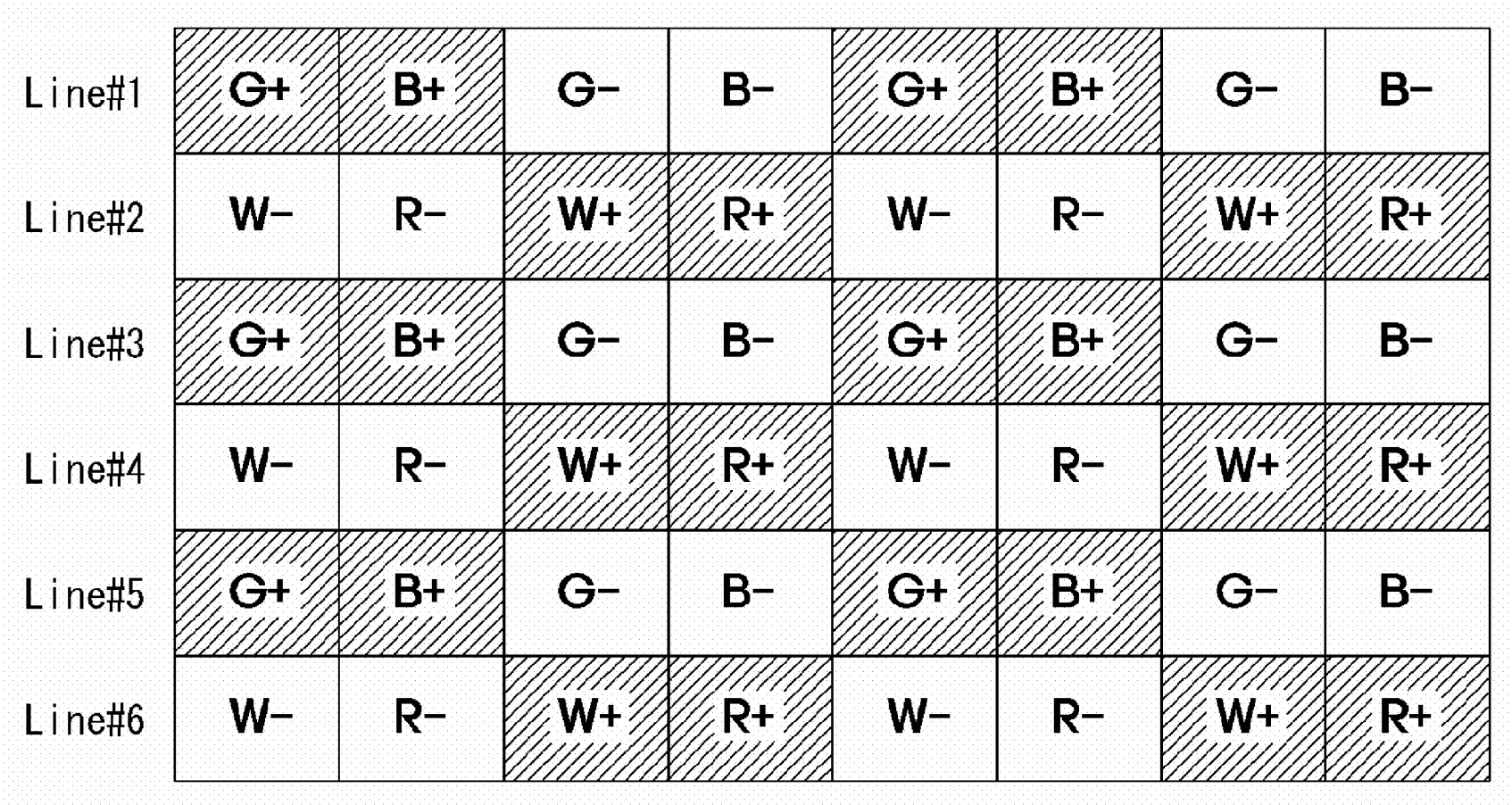
FIG. 16 illustrates an example where a data voltage, whose a polarity is inverted in vertical 1 dot and horizontal 2 dot inversion manners, is supplied to a liquid crystal display having a quad type pixel structure.

As shown in FIG. 16, if data voltages, whose polarities are inverted in vertical 1 dot and horizontal 2 dot inversion manners, are supplied to liquid crystal cells of a liquid crystal display panel having a quad type pixel structure, liquid crystal cells of the same color subpixels in the same column are charged to the data voltages with the same polarity. As a result, while a greenish image is displayed in odd-numbered columns, a magenta image is displayed in even-numbered columns. Namely, the color distortion appears and the flicker may appear every two columns.

To simultaneously solve the color distortion and the flicker illustrated in FIGS. 15 and 16 while the DC image sticking is prevented, the liquid crystal display according to the embodiment of the invention controls polarities of the data voltages supplied to the liquid crystal cells of the quad type liquid crystal display panel through a method illustrated in FIGS. 17A to 17D using the polarity control signals POL1, POL2, /POL1, and /POL2 illustrated in FIG. 9.

Figure 17A:
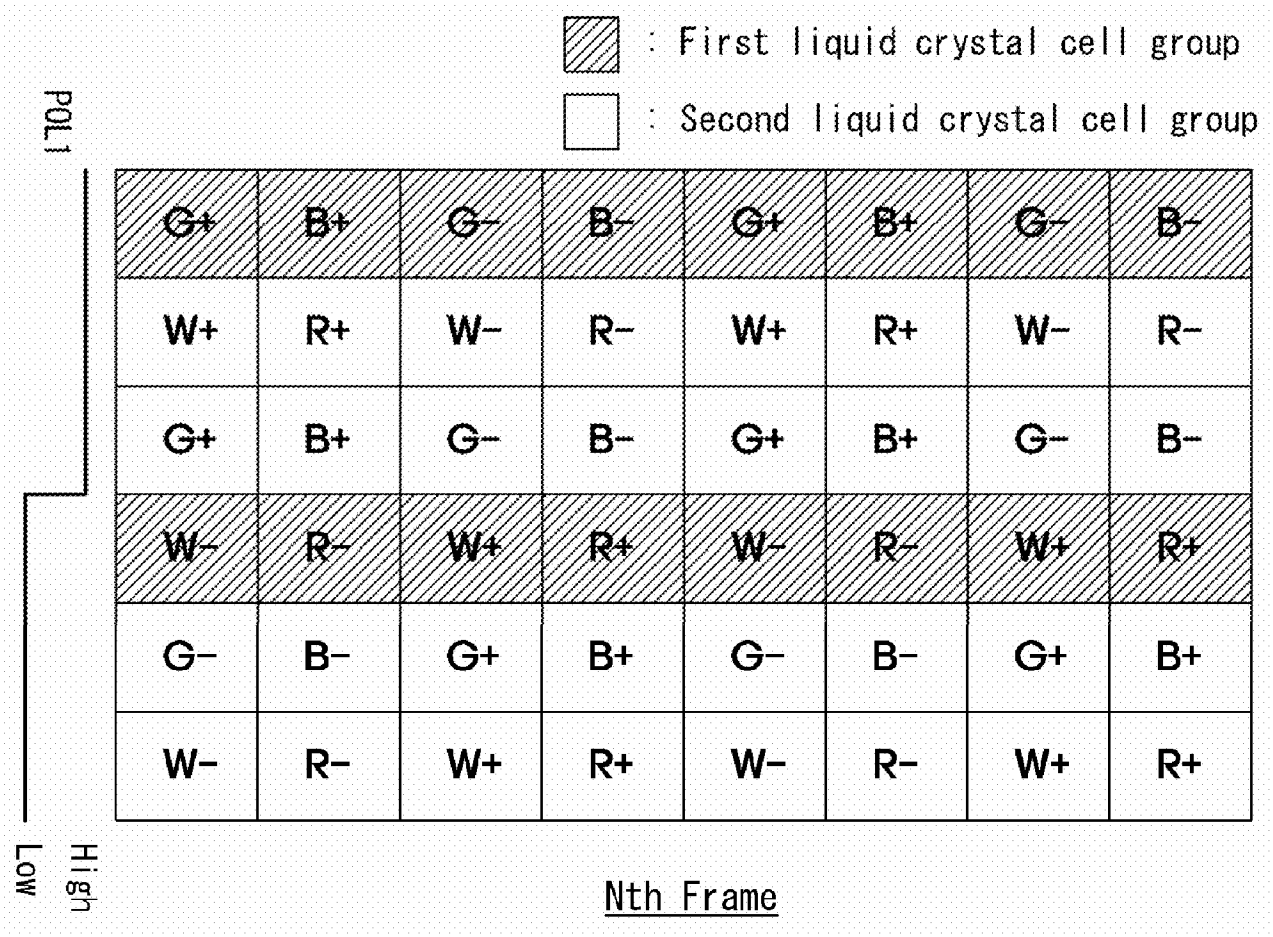
FIGS. 17A to 17D illustrate changes in polarities of data voltages supplied to liquid crystal cells of the liquid crystal display shown in FIG. 5 during N-th to (N+3)th frame periods.

As shown in FIG. 17A, the logic circuit 12 supplies the first polarity control signal POL1 to the data drive circuit 13 during an N-th frame period. As a result, the data drive circuit 13 controls polarities of the data voltages supplied to the data lines D1 to Dm of the liquid crystal display panel having the quad type pixel structure in conformity with a polarity pattern shown in FIG. 17A during the N-th frame period.

Polarities of the data voltages supplied to the liquid crystal cells are inverted in vertical 3 dot and horizontal 2 dot inversion manners. The polarities of the data voltages supplied to the liquid crystal cells change from a polarity pattern shown in FIG. 17D to a polarity pattern shown in FIG. 17A. Accordingly, as can be seen from FIGS. 17A and 17D, during the N-th frame period, while liquid crystal cells of (6j+1)th and (6j+4)th display lines Line #1 and Line #4 (where j is an integer equal to or greater than 0) are driven in conformity with the first liquid crystal cell group, liquid crystal cells of (6j+2)th, (6j+3)th, (6j+5)th and (6j+6)th display lines Line #2, Line #3, Line #5, and Line #6 are driven in conformity with the second liquid crystal cell group. As shown in FIG. 17A, because the data voltages of opposite polarities are supplied to the liquid crystal cells of the same color subpixels in the same line and the same column, the polarity bias of the data voltages scarcely appears. Accordingly, the liquid crystal display having the quad type pixel structure can display video data without the DC image sticking, the color distortion, and the flicker.

Figure 17B:
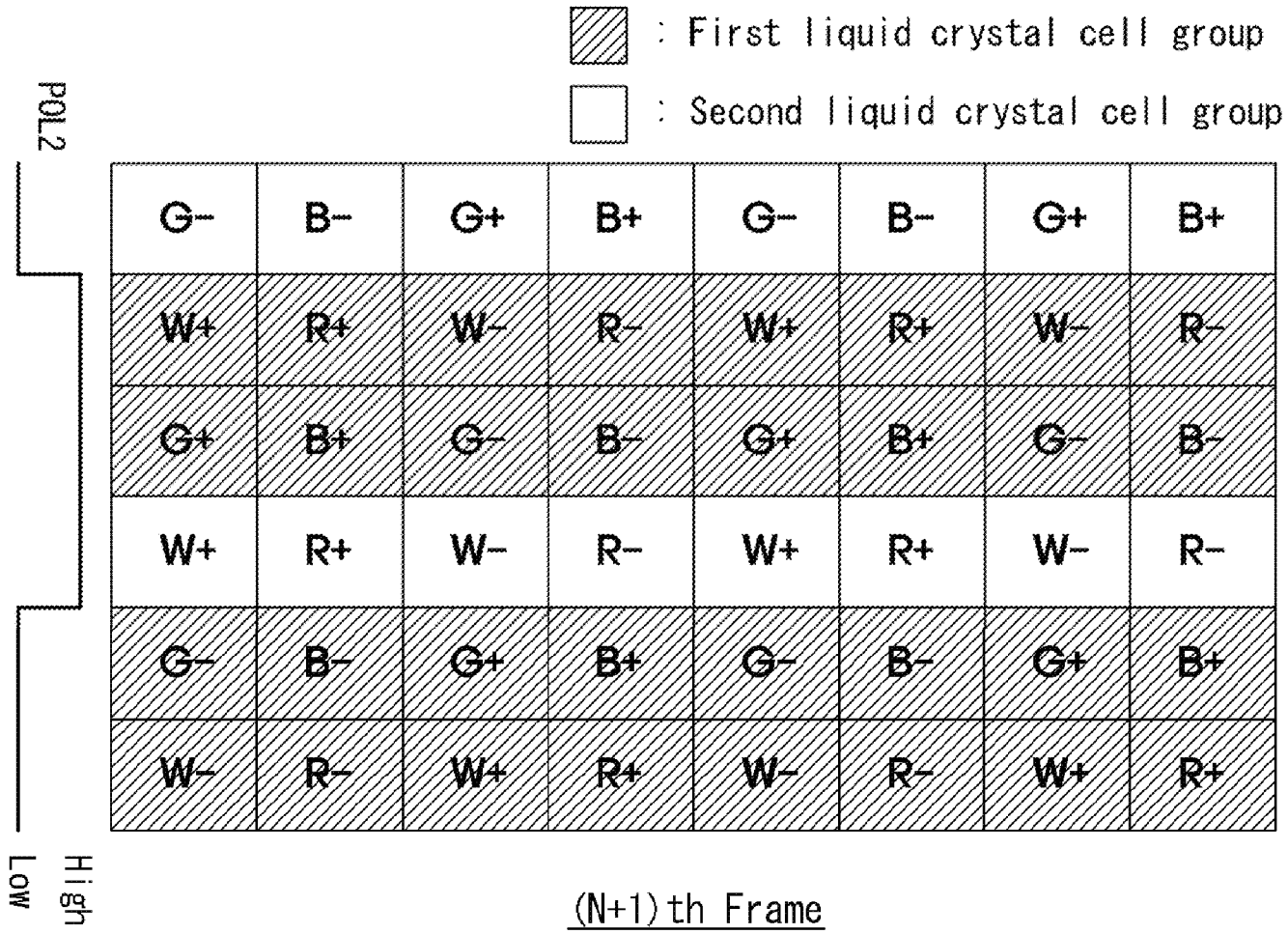

As shown in FIG. 17B, the logic circuit 12 supplies the second polarity control signal POL2 to the data drive circuit 13 during an (N+1)th frame period. As a result, the data drive circuit 13 controls polarities of the data voltages supplied to the data lines D1 to Dm of the liquid crystal display panel having the quad type pixel structure in conformity with a polarity pattern shown in FIG. 17B during the (N+1)th frame period.

Polarities of the data voltages supplied to the liquid crystal cells are inverted in the vertical 3 dot and horizontal 2 dot inversion manners. The polarities of the data voltages supplied to the liquid crystal cells change from a polarity pattern shown in FIG. 17A to a polarity pattern shown in FIG. 17B. Accordingly, as can be seen from FIGS. 17A and 17B, during the (N+1)th frame period, while liquid crystal cells of (6j+2)th, (6j+3)th, (6j+5)th and (6j+6)th display lines Line #2, Line #3, Line #5, and Line #6 are driven in conformity with the first liquid crystal cell group, liquid crystal cells of (6j+1)th and (6j+4)th display lines Line #1 and Line #4 are driven in conformity with the second liquid crystal cell group. As shown in FIG. 17B, because the data voltages of opposite polarities are supplied to the liquid crystal cells of the same color subpixels in the same line and the same column, the polarity bias of the data voltages scarcely appears. Accordingly, the liquid crystal display having the quad type pixel structure can display video data without the DC image sticking, the color distortion, and the flicker.

Figure 17C:
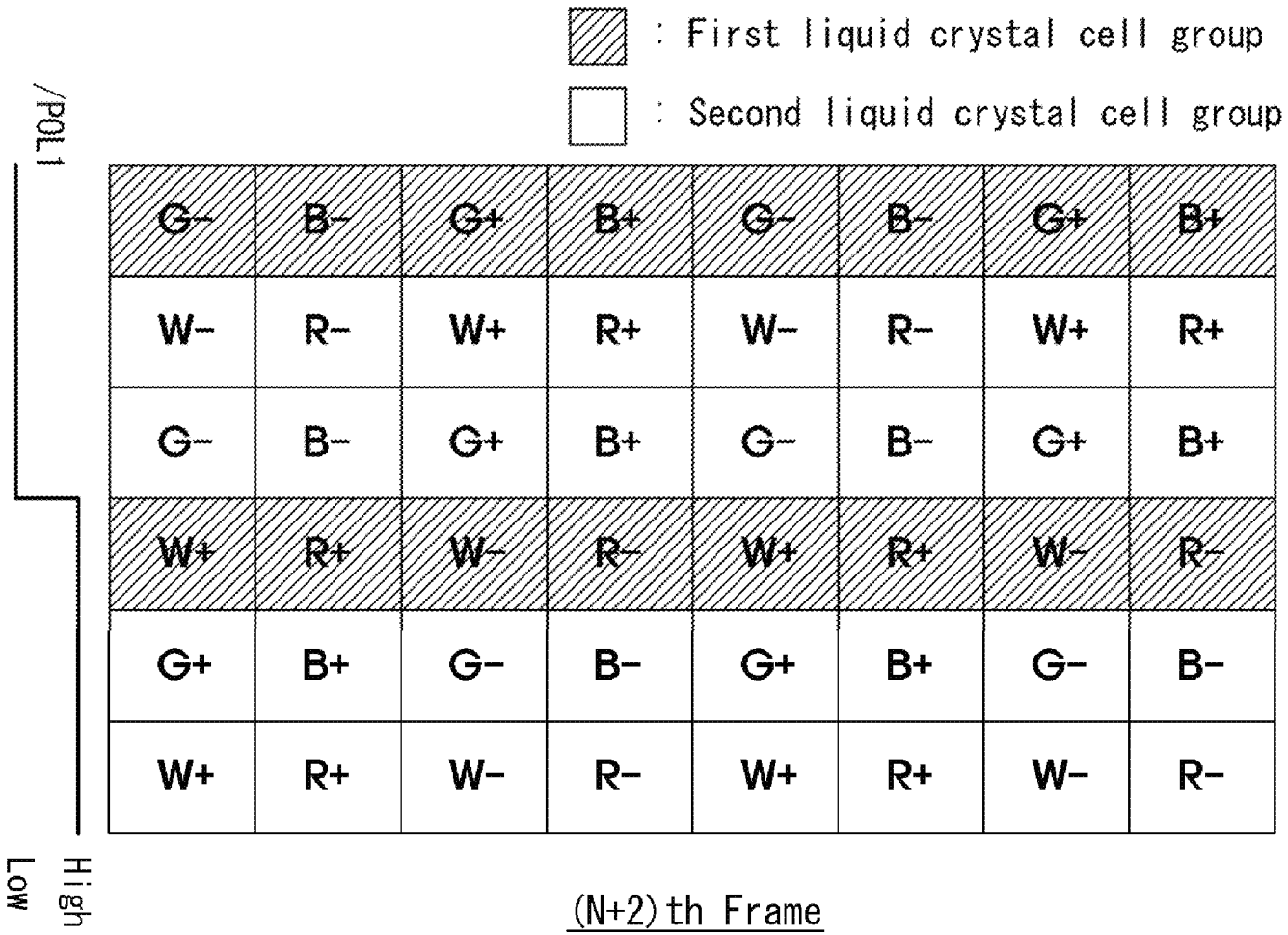

As shown in FIG. 17C, the logic circuit 12 supplies the first inversion polarity control signal /POL1 to the data drive circuit 13 during an (N+2)th frame period. As a result, the data drive circuit 13 controls polarities of the data voltages supplied to the data lines D1 to Dm of the liquid crystal display panel having the quad type pixel structure in conformity with a polarity pattern shown in FIG. 17C during the (N+2)th frame period.

Polarities of the data voltages supplied to the liquid crystal cells are inverted in the vertical 3 dot and horizontal 2 dot inversion manners. The polarities of the data voltages supplied to the liquid crystal cells change from a polarity pattern shown in FIG. 17B to a polarity pattern shown in FIG. 17C. Accordingly, as can be seen from FIGS. 17B and 17C, during the (N+2)th frame period, while liquid crystal cells of (6j+1)th and (6j+4)th display lines Line #1 and Line #4 are driven in conformity with the first liquid crystal cell group, liquid crystal cells of (6j+2)th, (6j+3)th, (6j+5)th and (6j+6)th display lines Line #2, Line #3, Line #5, and Line #6 are driven in conformity with the second liquid crystal cell group. As shown in FIG. 17C, because the data voltages of opposite polarities are supplied to the liquid crystal cells of the same color subpixels in the same line and the same column, the polarity bias of the data voltages scarcely appears. Accordingly, the liquid crystal display having the quad type pixel structure can display video data without the DC image sticking, the color distortion, and the flicker.

Figure 17D:
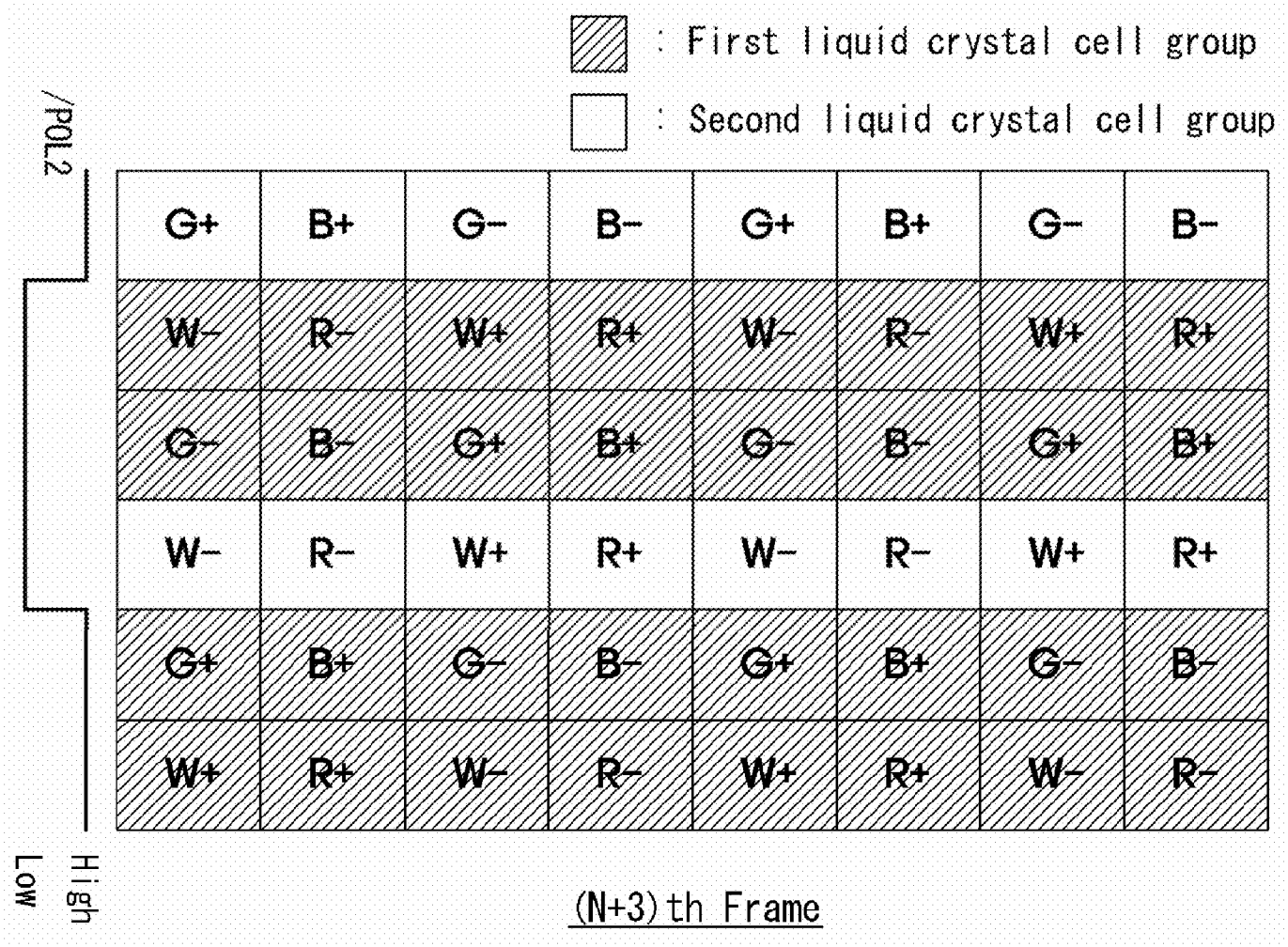

As shown in FIG. 17D, the logic circuit 12 supplies the second inversion polarity control signal /POL2 to the data drive circuit 13 during an (N+3)th frame period. As a result, the data drive circuit 13 controls polarities of the data voltages supplied to the data lines D1 to Dm of the liquid crystal display panel having the quad type pixel structure in conformity with a polarity pattern shown in FIG. 17D during the (N+3)th frame period.

Polarities of the data voltages supplied to the liquid crystal cells are inverted in the vertical 3 dot and horizontal 2 dot inversion manners. The polarities of the data voltages supplied to the liquid crystal cells change from a polarity pattern shown in FIG. 17C to a polarity pattern shown in FIG. 17D. Accordingly, as can be seen from FIGS. 17C and 17D, during the (N+3)th frame period, while liquid crystal cells of (6j+2)th, (6j+3)th, (6j+5)th and (6j+6)th display lines Line #2, Line #3, Line #5, and Line #6 are driven in conformity with the first liquid crystal cell group, liquid crystal cells of (6j+1)th and (6j+4)th display lines Line #1 and Line #4 are driven in conformity with the second liquid crystal cell group. As shown in FIG. 17D, because the data voltages of opposite polarities are supplied to the liquid crystal cells of the same color subpixels in the same line and the same column, the polarity bias of the data voltages scarcely appears. Accordingly, the liquid crystal display having the quad type pixel structure can display video data without the DC image sticking, the color distortion, and the flicker.

As described above, in the liquid crystal display having the quad type pixel structure and the method of driving the same according to the embodiments of the invention, because polarities of the data voltages supplied to the liquid crystal display are controlled according to the vertical 3 dot and horizontal 2 dot inversion manners and the phases of the polarity control signals for controlling the polarities of the data voltages change every 1 frame period, video data can be displayed without the DC image sticking, the color distortion, and the flicker.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display, comprising:

a liquid crystal display panel including a plurality of data lines, a plurality of gate lines crossing the data lines, and a plurality of liquid crystal cells, the liquid crystal display panel including a quad type pixel structure in which red, green, blue, and white subpixels constitute one pixel;

a logic circuit that sequentially outputs a plurality of polarity control signals, a logic level of each of the polarity control signals being inverted every three horizontal periods, phases of the polarity control signals being different from one another;

a data drive circuit that inverts a polarity of a data voltage in response to the polarity control signals received from the logic circuit to supply the data voltage with the inverted polarity to the data lines; and a gate drive circuit that sequentially supplies gate pulses to the gate lines, wherein the logic circuit supplies a first polarity control signal, including a logic level inverted every three horizontal periods, to the data drive circuit during an N-th frame period (where N is a positive integer), supplies a second polarity control signal subsequent to the first polarity control signal, including a logic level inverted every three horizontal periods and including a phase more delayed than a phase of the first polarity control signal by 1 horizontal period, to the data drive circuit during an (N+1)th frame period, including a first inversion polarity control signal subsequent to the second polarity control signal, including a logic level is inverted every three horizontal periods and including a phase is more delayed than a phase of the second polarity control signal by 2 horizontal periods, to the data drive circuit during an (N+2)th frame period, and supplies a second inversion polarity control signal subsequent to the first inversion polarity control signal, including a logic level is inverted every three horizontal periods and including a phase is more delayed than a phase of the first inversion polarity control signal by 1 horizontal period, to the data drive circuit during an (N+3)th frame period.

2. The liquid crystal display of claim 1, wherein the liquid crystal cells are charged to the data voltages including polarities are inverted in vertical 3 dot and horizontal 2 dot inversion manners.

3. The liquid crystal display of claim 1, wherein the logic circuit includes:

a first inverter that inverts the first polarity control signal to generate the first inversion polarity control signal;

a second inverter that inverts the second polarity control signal to generate the second inversion polarity control signal;

a frame controller that counts a number of frames periods to generate a selection signal; and a multiplexer that sequentially supplies the first, second, first inversion, and second inversion polarity control signals in the order named to the data drive circuit in response to the selection signal.

4. The liquid crystal display of claim 1, wherein:

the liquid crystal display panel includes (6j+1)th to (6j+6)th display lines, where j is an integer equal to or greater than 0;

liquid crystal cells of the (6j+1)th and (6j+4)th display lines are charged to the data voltage of the same polarity as a polarity of the data voltage, to which the liquid crystal cells of the (6j+1)th and (6j+4)th display lines were charged during an (N−1)th frame period, during the N-th frame period; and liquid crystal cells of the (6j+2)th, (6j+3)th, (6j+5)th, and (6j+6)th display lines are charged to the data voltage of a polarity opposite a polarity of the data voltage, to which the liquid crystal cells of the (6j+2)th, (6j+3)th, (6j+5)th, and (6j+6)th display lines were charged during the (N−1)th frame period, during the N-th frame period.

5. The liquid crystal display of claim 4, wherein:

the liquid crystal cells of the (6j+2)th, (6j+3)th, (6j+5)th, and (6j+6)th display lines are charged to the data voltage of the same polarity as a polarity of the data voltage, to which the liquid crystal cells of the (6j+2)th, (6j+3)th, (6j+5)th, and (6j+6)th display lines were charged during the N-th frame period, during the (N+1)th frame period; and the liquid crystal cells of the (6j+1)th and (6j+4)th display lines are charged to the data voltage of a polarity opposite a polarity of the data voltage, to which the liquid crystal cells of the (6j+1)th and (6j+4)th display lines were charged during the N-th frame period, during the (N+1)th frame period.

6. The liquid crystal display of claim 5, wherein:

the liquid crystal cells of the (6j+1)th and (6j+4)th display lines are charged to the data voltage of the same polarity as a polarity of the data voltage, to which the liquid crystal cells of the (6j+1)th and (6j+4)th display lines were charged during the (N+1)th frame period, during the (N+2)th frame period; and the liquid crystal cells of the (6j+2)th, (6j+3)th, (6j+5)th, and (6j+6)th display lines are charged to the data voltage of a polarity opposite a polarity of the data voltage, to which the liquid crystal cells of the (6j+2)th, (6j+3)th, (6j+5)th, and (6j+6)th display lines were charged during the (N+1)th frame period, during the (N+2)th frame period.

7. The liquid crystal display of claim 6, wherein:

the liquid crystal cells of the (6j+2)th, (6j+3)th, (6j+5)th, and (6j+6)th display lines are charged to the data voltage of the same polarity as a polarity of the data voltage, to which the liquid crystal cells of the (6j+2)th, (6j+3)th, (6j+5)th, and (6j+6)th display lines were charged during the (N+2)th frame period, during the (N+3)th frame period; and the liquid crystal cells of the (6j+1)th and (6j+4)th display lines are charged to the data voltage of a polarity opposite a polarity of the data voltage, to which the liquid crystal cells of the (6j+1)th and (6j+4)th display lines were charged during the (N+2)th frame period, during the (N+3)th frame period.

8. The liquid crystal display of claim 1, wherein:

the liquid crystal display panel includes a plurality of display lines on which the liquid crystal cells are arranged in a row direction and a plurality of columns on which the liquid crystal cells are arranged in a column direction; and liquid crystal cells of the same color subpixels existing in the same display line and the same column are charged to the data voltages with opposite polarities.

9. A method of driving a liquid crystal display including a liquid crystal display panel that includes a plurality of data lines, a plurality of gate lines crossing the data lines, and a plurality of liquid crystal cells and has a quad type pixel structure in which red, green, blue, and white subpixels constitute one pixel, the method comprising:

sequentially outputting a plurality of polarity control signals, a logic level of each of the polarity control signals being inverted every three horizontal periods, phases of the polarity control signals being different from one another;

inverting a polarity of a data voltage in response to the polarity control signals to supply the data voltage with the inverted polarity to the data lines; and sequentially supplying gate pulses to the gate lines, wherein the sequentially outputting of the plurality of polarity control signals comprises:

supplying a first polarity control signal, including a logic level is inverted every three horizontal periods, to a data drive circuit supplying the data voltage to the data lines during an N-th frame period (where N is a positive integer), supplying a second polarity control signal, including a logic level is inverted every three horizontal periods and including a phase is more delayed than a phase of the first polarity control signal by 1 horizontal period, to the data drive circuit during an (N+1)th frame period, supplying a first inversion polarity control signal, including a logic level is inverted every three horizontal periods and including a phase is more delayed than a phase of the second polarity control signal by 2 horizontal periods, to the data drive circuit during an (N+2)th frame period, and supplying a second inversion polarity control signal, including a logic level inverted every three horizontal periods and including a phase is more delayed than a phase of the first inversion polarity control signal by 1 horizontal period, to the data drive circuit during an (N+3)th frame period.

10. The method of claim 9, wherein the liquid crystal cells are charged to the data voltages including polarities are inverted in vertical 3 dot and horizontal 2 dot inversion manners.

11. The method of claim 9, wherein:

the liquid crystal display panel includes (6j+1)th to (6j+6)th display lines, where j is an integer equal to or greater than 0;

liquid crystal cells of the (6j+1)th and (6j+4)th display lines are charged to the data voltage of the same polarity as a polarity of the data voltage, to which the liquid crystal cells of the (6j+1)th and (6j+4)th display lines were charged during an (N−1)th frame period, during the N-th frame period; and liquid crystal cells of the (6j+2)th, (6j+3)th, (6j+5)th, and (6j+6)th display lines are charged to the data voltage of a polarity opposite a polarity of the data voltage, to which the liquid crystal cells of the (6j+2)th, (6j+3)th, (6j+5)th, and (6j+6)th display lines were charged during the (N−1)th frame period, during the N-th frame period.

12. The method of claim 11, wherein:

the liquid crystal cells of the (6j+2)th, (6j+3)th, (6j+5)th, and (6j+6)th display lines are charged to the data voltage of the same polarity as a polarity of the data voltage, to which the liquid crystal cells of the (6j+2)th, (6j+3)th, (6j+5)th, and (6j+6)th display lines were charged during the N-th frame period, during the (N+1)th frame period; and the liquid crystal cells of the (6j+1)th and (6j+4)th display lines are charged to the data voltage of a polarity opposite a polarity of the data voltage, to which the liquid crystal cells of the (6j+1)th and (6j+4)th display lines were charged during the N-th frame period, during the (N+1)th frame period.

13. The method of claim 12, wherein:

the liquid crystal cells of the (6j+1)th and (6j+4)th display lines are charged to the data voltage of the same polarity as a polarity of the data voltage, to which the liquid crystal cells of the (6j+1)th and (6j+4)th display lines were charged during the (N+1)th frame period, during the (N+2)th frame period; and the liquid crystal cells of the (6j+2)th, (6j+3)th, (6j+5)th, and (6j+6)th display lines are charged to the data voltage of a polarity opposite a polarity of the data voltage, to which the liquid crystal cells of the (6j+2)th, (6j+3)th, (6j+5)th, and (6j+6)th display lines were charged during the (N+1)th frame period, during the (N+2)th frame period.

14. The method of claim 13, wherein:

the liquid crystal cells of the (6j+2)th, (6j+3)th, (6j+5)th, and (6j+6)th display lines are charged to the data voltage of the same polarity as a polarity of the data voltage, to which the liquid crystal cells of the (6j+2)th, (6j+3)th, (6j+5)th, and (6j+6)th display lines were charged during the (N+2)th frame period, during the (N+3)th frame period; and the liquid crystal cells of the (6j+1)th and (6j+4)th display lines are charged to the data voltage of a polarity opposite a polarity of the data voltage, to which the liquid crystal cells of the (6j+1)th and (6j+4)th display lines were charged during the (N+2)th frame period, during the (N+3)th frame period.

15. The method of claim 9, wherein:

the liquid crystal display panel includes a plurality of display lines on which the liquid crystal cells are arranged in a row direction and a plurality of columns on which the liquid crystal cells are arranged in a column direction; and liquid crystal cells of the same color subpixels existing in the same display line and the same column are charged to the data voltages with opposite polarities.

* * * * *